US008711085B2

(12) United States Patent
Ward et al.

(10) Patent No.: US 8,711,085 B2
(45) Date of Patent: Apr. 29, 2014

(54) APPARATUS AND METHODS FOR COLOR DISPLAYS

(75) Inventors: Gregory J. Ward, Berkeley, CA (US); Helge Seetzen, Westmount, CA (US); Trevor Davies, Walnut Creek, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 171 days.

(21) Appl. No.: 13/145,788

(22) PCT Filed: Jan. 20, 2010

(86) PCT No.: PCT/US2010/021539

§ 371 (c)(1),
(2), (4) Date: Jul. 21, 2011

(65) Prior Publication Data

US 2011/0273495 A1 Nov. 10, 2011

Related U.S. Application Data

(60) Provisional application No. 61/146,246, filed on Jan. 21, 2009.

(51) Int. Cl.
*G09G 3/34* (2006.01)

(52) U.S. Cl.
USPC ..... 345/102; 345/690

(58) Field of Classification Search
None
See application file for complete search history.

(56) References Cited

U.S. PATENT DOCUMENTS

| | | | |
|---|---|---|---|
| 5,563,621 | A | 10/1996 | Silsby |
| 6,392,717 | B1 | 5/2002 | Kunzman |
| 6,453,067 | B1 | 9/2002 | Morgan |
| 6,570,584 | B1 | 5/2003 | Cok |
| 6,724,934 | B1 | 4/2004 | Lee |
| 6,870,323 | B1 | 3/2005 | Cok |
| 6,876,764 | B2 | 4/2005 | Lee |
| 6,897,876 | B2 | 5/2005 | Murdoch |
| 6,909,233 | B2 | 6/2005 | Cok |
| 6,911,772 | B2 | 6/2005 | Cok |
| 6,919,681 | B2 | 7/2005 | Cok |
| 7,009,343 | B2 | 3/2006 | Lim |
| 7,075,242 | B2 | 7/2006 | Miller |
| 7,091,523 | B2 | 8/2006 | Cok |
| 7,091,941 | B2 | 8/2006 | Arnold |

(Continued)

FOREIGN PATENT DOCUMENTS

| | | |
|---|---|---|
| JP | 2005-259699 | 9/2005 |
| JP | 4995733 | 7/2008 |

(Continued)

OTHER PUBLICATIONS

Shiga, et al., "Power Savings and Enhancement of Gray-Scale Capability of LCD TVs with an Adaptive Dimming Technique" Journal of the Society for Information Display, vol. 16, No. 2, Feb. 2008, pp. 311-316.

(Continued)

*Primary Examiner* — Joseph Haley

(57) ABSTRACT

A display incorporates both narrow-band light emitters and broadband light emitters. The light emitters are controlled to display images according to image data. The narrow-band light emitters can be used to provide highly saturated primary colors. Light from the broadband light sources may be mixed with the broadband light. This can reduce metamerism failures arising from variations in the characteristics of the eyes of observers.

10 Claims, 11 Drawing Sheets

(56) References Cited

U.S. PATENT DOCUMENTS

| | | | | |
|---|---|---|---|---|
| 7,184,067 | B2 | 2/2007 | Miller | |
| 7,230,594 | B2 | 6/2007 | Miller | |
| 7,256,557 | B2 | 8/2007 | Lim | |
| 7,333,080 | B2 | 2/2008 | Miller | |
| 7,333,165 | B2 | 2/2008 | Nakano | |
| 7,397,485 | B2 | 7/2008 | Miller | |
| 8,018,427 | B2 * | 9/2011 | Hamada | 345/102 |
| 2004/0061814 | A1 | 4/2004 | Kim | |
| 2004/0070966 | A1 | 4/2004 | Ahn | |
| 2004/0264212 | A1 | 12/2004 | Chung | |
| 2005/0185147 | A1 | 8/2005 | Berman | |
| 2007/0057901 | A1 * | 3/2007 | Chino | 345/102 |
| 2007/0064422 | A1 | 3/2007 | Murai | |
| 2008/0030985 | A1 | 2/2008 | Jeon | |
| 2008/0084524 | A1 | 4/2008 | Inuzuka | |
| 2008/0150863 | A1 * | 6/2008 | Morisue et al. | 345/88 |
| 2008/0203899 | A1 | 8/2008 | Miller | |
| 2009/0267879 | A1 | 10/2009 | Masuda | |

FOREIGN PATENT DOCUMENTS

| | | |
|---|---|---|
| WO | 02/069030 | 9/2002 |
| WO | 03/077013 | 9/2003 |
| WO | 2006/010244 | 2/2006 |
| WO | 2006/066380 | 6/2006 |
| WO | 2007132364 | 11/2007 |
| WO | WO 2007125623 A1 * | 11/2007 |
| WO | 2008050506 | 5/2008 |

OTHER PUBLICATIONS

Abramov, et al., "Color Appearance: on Seeing Red-or Yellow, or Green, or Blue" vol. 45, Jan. 1994, pp. 451-485.

* cited by examiner

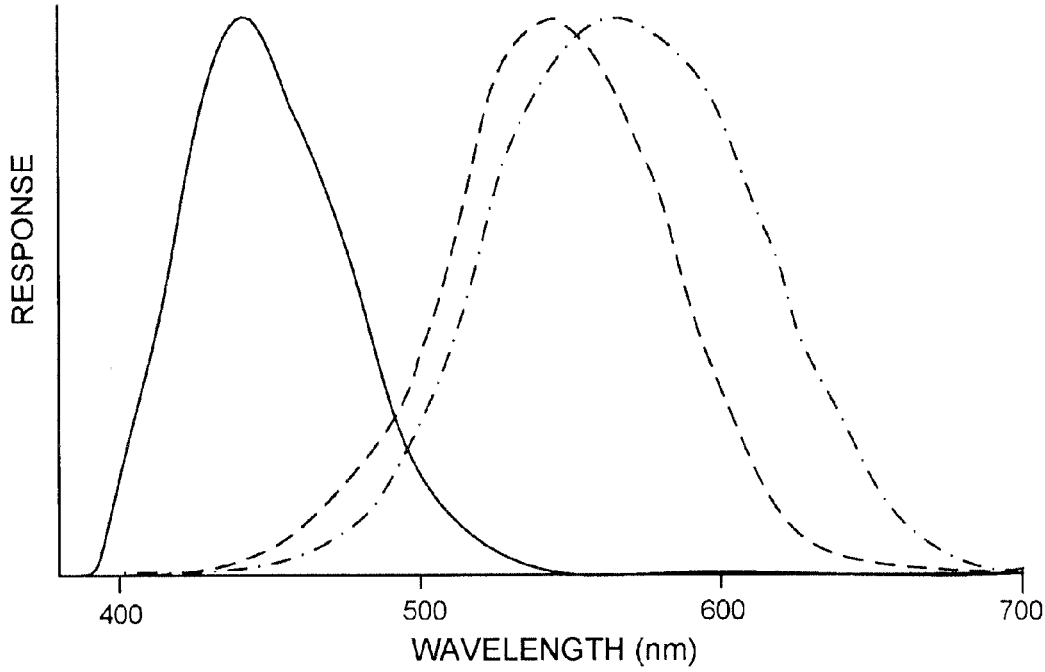
FIGURE 1 - PRIOR ART
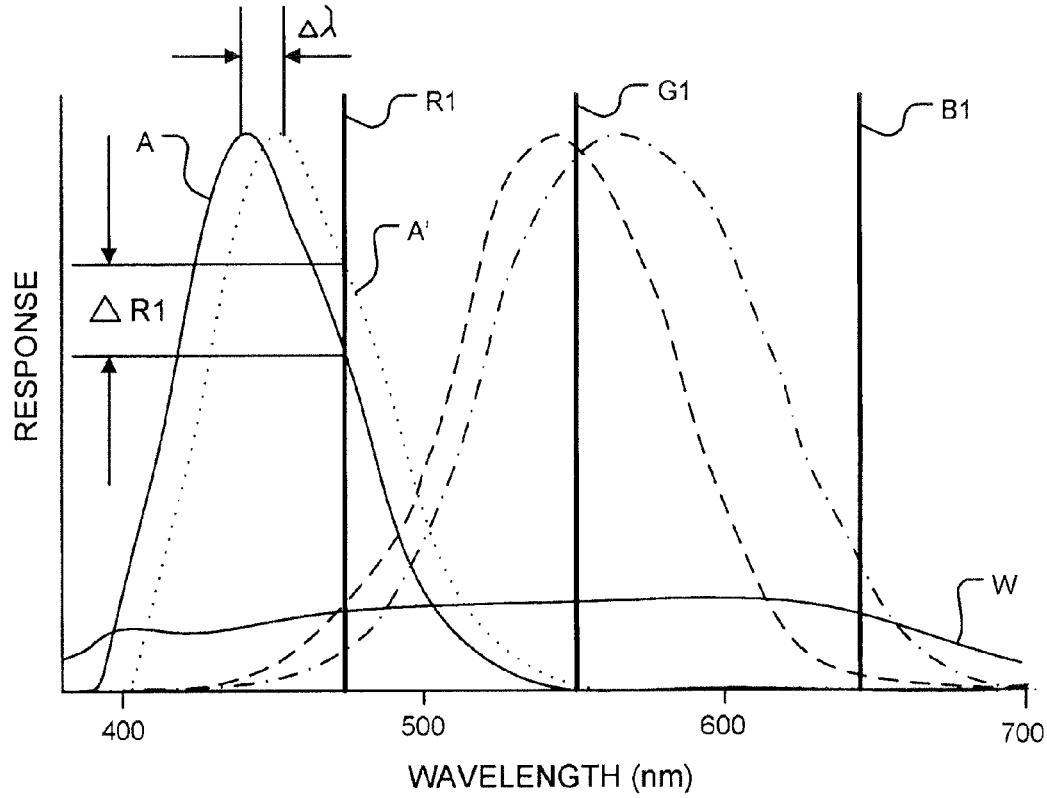
FIGURE 2 - PRIOR ART

APPARATUS AND METHODS FOR COLOR DISPLAYS

CROSS-REFERENCE TO RELATED APPLICATIONS

This application claims priority to U.S. Provisional Patent Application No. 61/146,246 filed Jan. 21, 2009, hereby incorporated by reference in its entirety.

TECHNICAL FIELD

The invention relates to displays such as computer displays, televisions, home cinema displays, and the like.

BACKGROUND

The human eye contains three types of color receptors (these are sometimes called red-absorbing cones, green-absorbing cones and blue-absorbing cones). These color receptors each respond to light over a wide range of visible wavelengths. Each of the types of receptor is most sensitive at a different wavelength. Red-absorbing cones typically have a peak sensitivity at roughly 565 nm. Green-absorbing cones typically have peak sensitivity at roughly 535 nm. Blue-absorbing cones typically have a peak sensitivity at roughly 440 nm. This arrangement is illustrated schematically in FIG. 1. The sensation of color perceived by a human observer when light is incident upon the observer's eye depends upon the degree to which each of the three types of receptor is excited by the incident light.

Conveniently, the human visual system ("HVS") does not distinguish between light of different spectral compositions that causes the same degree of stimulation of each of the different types of color receptor (e.g. light having different spectral power distributions that have the same tristimulus values). A sensation of any color within a gamut of colors can be created by exposing an observer to light made up of a mixture of three primary colors. The primary colors may each comprise only light in a narrow band. Many current displays use different mixtures of red, green and blue (RGB) light to generate sensations of a large number of colors.

Saturation is a measure which takes into account intensity of light and the degree to which the light is spread across the visible spectrum. Light that is both very intense and concentrated in a narrow wavelength range has a high saturation. Saturation is decreased as the intensity decreases and/or the light contains spectral components distributed over a broader wavelength band. Saturation can be reduced by mixing in white or other broad-band light.

Patent literature in the field of color display includes:

U.S. Pat. Nos. 7,397,485; 7,184,067; 6,570,584; 6,897,876; 6,724,934; 6,876,764; 5,563,621; 6,392,717; 6,453,067;

US patent application No. 20050885147; and,

PCT publication Nos. WO2006010244; WO 02069030 and WO03/077013.

There is demand for displays capable of accurately and consistently representing colors. There is a need for displays, display components and associated methods which can facilitate providing high quality color images.

SUMMARY OF THE INVENTION

This invention may be implemented in a wide variety of embodiments. The invention has application in a wide variety of types of display from televisions to digital cinema projectors.

One aspect of the invention provides displays comprising a viewing screen. A plurality of narrow-band light-emitting elements are arranged to illuminate the viewing screen with narrow-band light of a plurality of colors. At least one broadband light source is arranged to illuminate the viewing screen with broadband light having a broadband spectral power distribution. In some embodiments, the viewing screen comprises a spatial light modulator. In some embodiments a spatial light modulator is provided in an optical path between the narrow-band light-emitting elements and the viewing screen.

Another aspect of the invention provides displays comprising a spatial light modulator comprising an array of controllable pixels. A light source is arranged to illuminate the spatial light modulator. The light source comprises a plurality of groups of narrow-band light-emitting elements and at least one broadband light emitting element capable of emitting broadband light. The narrow-band light emitting elements of each group are capable of emitting narrow-band light of one of a plurality of primary colors defining a color gamut. A controller is configured to control the pixels of the spatial light modulator and the light source according to image data defining an image to be displayed.

Another aspect of the invention provides displays comprising a viewing screen, a color narrow-band projector arranged to project an image made up of narrow-band light of a plurality of colors onto the viewing screen; and a broadband light projector arranged to project an image made up of broadband light onto the viewing screen. A controller is configured to control the relative amounts of broadband and narrow-band light projected to areas on the viewing screen.

Another aspect of the invention provides methods for displaying color images. The methods may comprise, for each of a plurality of areas of the image: determining a chromaticity for the area and determining an amount of light in each of a plurality of spectral ranges required to replicate the area of the image. If the chromaticity for the area is within a chroma region one or more broadband light emitters is controlled to generate at least the required amount of light for each of the spectral ranges for the area. If the chromaticity for the area is outside the chroma region, one or more narrow-band light emitters are controlled to generate at least a portion of the required amount of light for one or more of the spectral ranges for the area. The method may be implemented by a controller for a display, for example.

Another aspect of the invention provide methods for displaying color images on a display. The display comprises a plurality of controllable narrow-band light emitting elements capable of emitting narrow-band light of a plurality of primary colors defining a color gamut and one or more broadband light emitting elements. The methods comprise, for each of a plurality of areas of the image to be displayed: determining a representative chromaticity of the area; determining if the representative chromaticity is in a defined chroma region; if the representative chromaticity is not in the defined chroma region, then establishing driving signals for the narrow-band light emitting elements that correspond to the area; if the representative chromaticity is in the defined chroma region, then establishing driving signals for the broadband light emitting elements that correspond to the area; and applying the driving signals to the broadband or narrow-band light emitting elements that correspond to the area.

Another aspect of the invention provides methods for displaying color images. The methods comprise generating portions of the image for which image data specifies colors having saturation values above a threshold with light from one or more narrow-band light emitters and generating portions of the image for which the image data specifies colors having saturation values below the threshold with light from one or more broadband light emitters.

Another aspect of the invention provides methods for displaying color images. The methods use a plurality of controllable narrow-band light emitting elements capable of emitting narrow-band light of a plurality of primary colors and one or more controllable broadband light emitting elements. The methods comprise, for each of a plurality of areas of the image: determining a representative chromaticity and luminance for the area; determining saturation indices for the primary colors based at least in part on the representative chromaticity and luminance; and comparing the saturation indices to first and second thresholds, wherein the second threshold is greater than the first threshold. If all the saturation indices are less than the first threshold, the methods proceed to determine driving values for the broadband light emitters corresponding to the area. Otherwise, if any of the saturation indices are greater than the second threshold, the methods determine driving values for the narrow-band light emitters corresponding to the area. Otherwise, if none of the saturation indices are greater than the second threshold and not all of the saturation indices are less than the first threshold, the methods determine driving values for both the broadband and narrow-band light emitters corresponding to the area.

Another aspect of the invention provides methods for displaying color images. The methods use a plurality of controllable narrow-band light emitting elements capable of emitting narrow-band light of a plurality of primary colors and one or more controllable broadband light emitting elements that are arranged to illuminate a two-dimensional spatial light modulator comprising an array of pixels. The methods comprise, for each of a plurality of areas of the spatial light modulator: determining color values for pixels within the area; determining an initial set of driving values for the narrow-band light emitting elements corresponding to the area based at least in part on the color values; for pixels within the area, estimating an amount of desaturation resulting from illumination of the pixel from the narrow-band light emitting elements driven according to the initial set of driving values; determining driving values for those of the broadband light emitting elements corresponding to the area based at least in part on the estimated amounts of desaturations; and recalculating the set of driving values for the narrow-band light emitting elements corresponding to the area based at least in part on the driving values of the broadband light emitting elements and information characterizing a spectrum of light from the broadband light emitting elements.

Another aspect of the invention provides controllers for colour displays. The controllers are configured to control displays comprising a plurality of controllable narrow-band light emitting elements, one or more controllable broadband light emitting elements and a spatial light modulator comprising an array of controllable pixels. the controllers are configured to display a color image by: determining a representative chromaticity for an area of the image; determining a relative amount of broadband light to narrow-band light to provide to a corresponding area of the spatial light modulator based at least in part on the representative chromaticity; controlling the broadband and narrow-band emitting elements to provide the determined relative amounts of broadband to narrow-band light to the area; and controlling the pixels of the spatial light modulator to adjust an amount of the light that is passed to a viewer to replicate the image to be displayed.

Another aspect of the invention provides tangible storage media containing machine-readable instructions that can cause a data processor in a controller for a color display to perform a method of displaying a color image according to any of the inventive methods described herein.

Another aspect of the invention provides methods for displaying color images. The methods comprise, for each of a plurality of areas of the image: determining a saturation value corresponding to the area for each of a plurality of spectral ranges; comparing the saturation values to corresponding thresholds; if the saturation values are less than the corresponding thresholds, generating the area of the image with light from one or more broadband light emitters; and, if one or more of the saturation values exceeds the corresponding threshold generating the area of the image with light from one or more narrow-band light emitters.

Another aspect of the invention provides controllers for color displays and components for controllers of color displays that are configured to control the color displays according to any of the inventive methods described herein.

Further aspects of the invention and features of specific embodiments of the invention are described below.

BRIEF DESCRIPTION OF THE DRAWINGS

The accompanying drawings illustrate non-limiting embodiments of the invention.

FIG. 1 is a graph illustrating the response of color sensors of the human eye to light of different wavelengths in the visible spectrum.

FIG. 2 is a graph illustrating the response of color sensors of the human eye to light of different wavelengths in the visible spectrum illustrating schematically a variation between two individual humans.

DESCRIPTION

Figure 3:
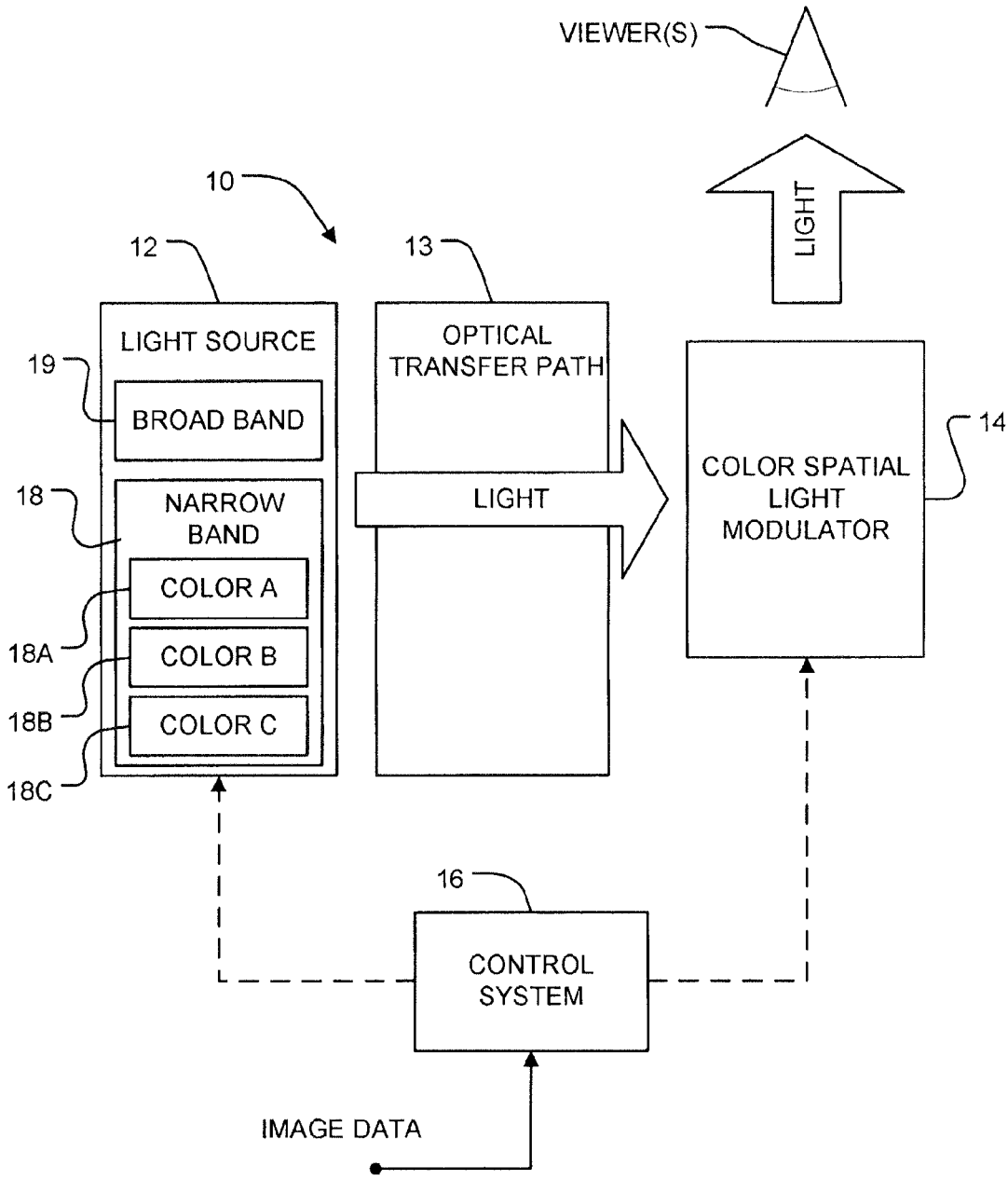
FIG. 3 is a block diagram of a display according to an example embodiment of the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The invention relates to displays, components for displays and related methods. Narrow-band light sources can advantageously provide highly-saturated colors. A set of narrow-band light sources of appropriate chromacities can provide a wide color gamut. Some types of narrow-band light emitter are advantageously efficient.

The inventors have determined that current display technology which uses narrow-band light sources, such as primary-color LEDs, does not adequately take into account variations in color receptors across the human population. These variations can result in different observers disagreeing as to whether a subjective color sensation produced by viewing a display matches that for a particular color which the display is intended to reproduce. Such apparent color mismatches may be called 'observer metameric failures'. Observer metameric failures can result in some observers seeing that a displayed color matches a color sample whereas other observers disagree that the displayed color matches the color sample. This problem is particularly acute in cases where the primary light sources are narrow-band light sources. The inventors have recognized a need for displays that can advantageously exploit narrow-band light sources while reducing or avoiding metameric failures.

This problem is illustrated by FIG. 2 which shows the simple example case where the response curve A of a first color receptor of a first person is shifted by an amount $\Delta\lambda$ relative to the response curve A' of a second person. Consider the case where these two persons are exposed to two "off-white" color samples; one composed of a mixture of narrow-band red light R1, narrow-band green light G1 and narrow-band blue light B1, and the other composed of light having a broad spectrum W. Further, consider that response curve A of the first person is such that he or she perceives the two samples to be of identical color (in other words the two samples cause the same degree of stimulation of each of the different types of color receptors for that person). As is illustrated in FIG. 2, the different response curves A and A' will result in a significant difference in the output of the first color receptor for the two persons in relation to the narrow-band light sample (e.g. a difference of $\Delta$R1 for the red receptors), but will not result in a significant difference in the output of the color receptor for the two persons in relation to the broad-band light W. Thus, the second person will not agree that the two samples are of identical color. Some embodiments of the invention address this issue while maintaining the benefits of high saturation and wide color gamut that can be achieved through the appropriate application of narrow-band light sources.

FIG. 3 illustrates a display 10 according to an example embodiment of the invention. Display 10 comprises a light source 12, a color spatial light modulator 14 and a control system 16 that drives light source 12 and spatial modulator 14 to display a desired image for viewing. Light travels from light source 12 to color spatial light modulator 14 by way of an optical transfer path 13. Optical transfer path 13 may comprise open space and/or may pass through one or more optical components that influence the propagation of light. By way of example only, optical transfer path 13 may comprise optical components such as diffusers, anti-reflection films, light guides, minors, lenses, prisms, beam splitters, beam combiners or the like.

Light source 12 comprises a plurality of independently-controllable light-emitting elements. The light emitting elements include narrow-band light emitting elements 18 and broad-band light emitting elements 19. Narrow-band light emitting elements 18 are of a plurality of types (18A, 18B and 18C are shown) that define a color gamut. For example, narrow-band light emitting elements 18 may comprise:

sources of red, green and blue light;

sources of red, green, blue and yellow light;

sources of light of three, four, five or more primary colors that define a color gamut; etc.

By way of example, narrow-band light emitting elements 18 may comprise light-emitting diodes (LEDs), other light-emitting semiconductor devices such as laser diodes, lasers, other sources of narrow-band light such as light that has been filtered by narrow-band filters, or the like. In some embodiments narrow-band light emitting elements 18 each emit light that is monochromatic or quasi-monochromatic. In some embodiments the narrow-band light emitting elements emit light having a bandwidth of 50 nm or less.

In some but not all embodiments broadband light emitting elements 19 emit white light having a relatively wide spectral distribution. Broad-band light emitting elements may comprise, for example:

fluorescent lamps;

incandescent lamps;

white-emitting LEDs;

stimulated phosphors;

etc.

In some embodiments, broadband light emitting elements 19 emit light having a spectral bandwidth (at half maximum) of at least 150 nm. In some embodiments, broadband light emitting elements 19 emit light having a spectral bandwidth (at half maximum) of at least 200 nm.

Broad-band light emitting elements 19 are not limited to being of only one type. Some embodiments provide two or more types of broadband light emitting elements 19 capable of emitting light having different, possibly overlapping, broadband spectra. Examples of broadband light emitting elements that may be provided include:

white light sources (in some embodiments multiple white light sources having different white points);

broadband blue-green light sources;

broadband yellow light sources;

broadband magenta light sources;

mixtures thereof;

etc.

It is not mandatory that each broadband light source 19 be made up of only a single device. A broadband light source 19 may comprise two or more light-emitting devices that are controlled together to emit light that is combined at or upstream from spatial light modulator 14 to provide broad-band illumination of spatial light modulator 14.

Color spatial light modulator 14 comprises an array of individually-controllable elements that pass light in corresponding color bands. Spatial modulator 14 may comprise, for example an array of addressable pixels each pixel having a plurality of addressable sub-pixels. The sub-pixels are associated with corresponding color filters. The sub-pixels are controllable to vary the amount of the light that is incident on the sub-pixel that is passed to a viewer. The color filters of spatial light modulator 14 may have pass bands significantly broader than the peaks in the emission spectra for the narrow-band light emitters 18.

Color spatial light modulator 14 may, for example, comprise a reflection-type spatial light modulator or a transmission-type spatial light modulator. By way of example, spatial light modulator 14 may comprise a liquid crystal display (LCD) panel. The display panel may be, for example an RGB or RGBW display panel. In other example embodiments, spatial light modulator 14 may comprise a liquid crystal on silicon (LCOS) or other reflective-type spatial light modulator.

Control system 16 comprises one or more of: logic circuits (which may be hard-wired or provided by a configurable logic device such as a field-programmable gate array—'FPGA'); one or more programmed data processors (for example, the data processors may comprise microprocessors, digital signal processors, programmable graphics processors, co-processors or the like); and suitable combinations thereof. A tangible storage medium may be provided that contains instructions that can cause control system 16 to be configured to provide logic functions as described herein. The tangible storage medium may, for example, comprise software instructions to be executed by one or more data processors and/or configuration information for one or more configurable logic circuits.

Control system 16 is configured to generate driving signals for light emitters 18, 19 of light source 12 and controllable elements of spatial light modulator 14 in response to image data. The image data may comprise data specifying one or more still images or data specifying a moving image (for example, a sequence of video frames).

Some embodiments of the invention provide dual modulation type displays. In such displays a pattern of light is projected onto a spatial light modulator. The pattern is controlled according to image data and the spatial light modulator further modulates light in the pattern to yield an image viewable by an observer. Some examples of such displays have individual backlights that can be locally dimmed. Some examples of dual modulation type displays are described in: PCT/CA2005/000807 published as WO2006010244 and entitled RAPID IMAGE RENDERING ON DUAL-MODULATOR DISPLAYS; PCT/CA2002/000255 published as WO 02069030 and entitled HIGH DYNAMIC RANGE DISPLAY DEVICES; and PCT/CA2003/000350 published as WO03/077013 and entitled HIGH DYNAMIC RANGE DISPLAY DEVICES.

Where display 10 is a dual modulation type display, light source 12 is controllable to alter the spatial distribution of light over the controllable elements of spatial modulator 14 from at least narrow-band light emitting elements 18 and controller 16 controls the spatial distribution of light from at least narrow-band light emitting elements 18 over spatial light modulator 14.

In the example embodiment described below, light source 12 is controllable to alter the spatial distribution of light produced on spatial modulator 14 from narrow-band light emitting elements 18 and broadband light emitting elements 19. This control may be achieved in a variety of ways including:

providing in light source 12 one or more spatial light modulators configured to permit control of the spatial distribution on spatial light modulator 14 of light emitted by light source 12; and, providing in light source 12 a plurality of individually-controllable light emitting elements that each illuminate different parts of spatial light modulator 14 in different degrees. In some embodiments each of the types of light-emitting elements are fairly uniformly distributed over an area of light source 12. Within each type of the light-emitting elements individual light-emitting elements or individual groups of the light-emitting elements are controllable so as to alter a distribution of light from the light-emitting elements at spatial light modulator 14.

The control may comprise adjusting the brightness of individual light-emitting elements or groups of the light-emitting elements. The brightness may be controlled, for example, by setting one or more of a driving current, driving voltage, and duty cycle, for a light-emitting element such as a LED. Where there is a sufficiently high density of individual light-emitting elements, the control may comprise turning individual ones of the light-emitting elements on or off. For example, if each area of spatial light modulator 14 is illuminated primarily by a group of 15 closely-spaced light-emitting elements of a particular type then an area of spatial light modulator 14 can be illuminated at any one of 16 different levels by turning on zero, one, two or up to all 15 of the corresponding light-emitting elements.

Figure 4:
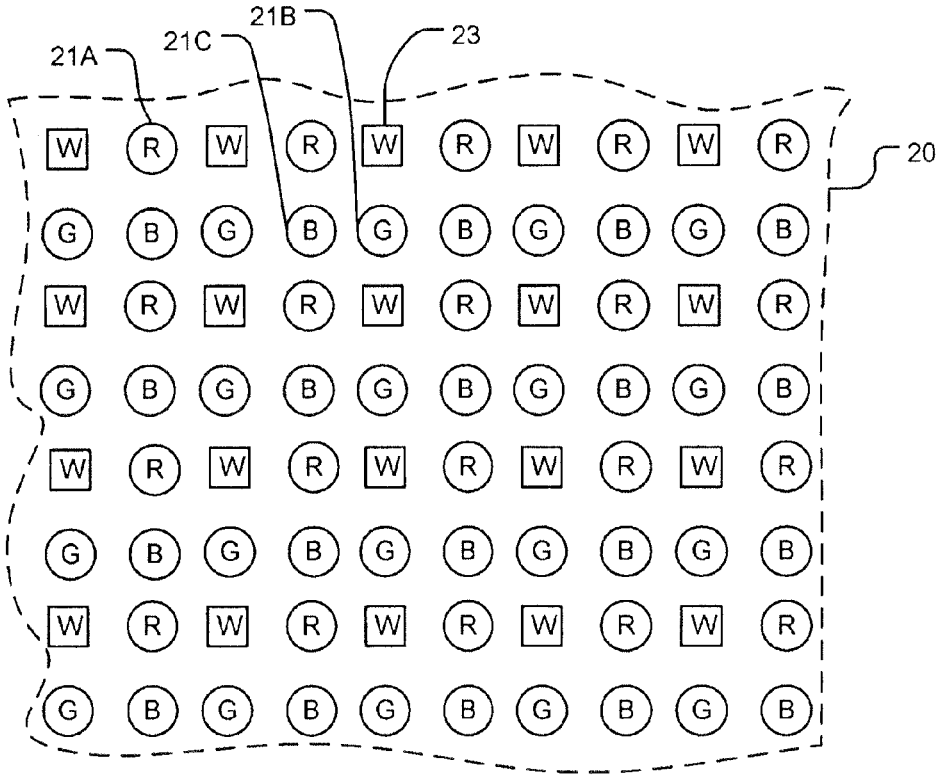
FIG. 4 is a front view of a backlight of a type that may be used in embodiments of the invention.

FIG. 4 shows a portion of an example light source 20 that includes a plurality of each of the different types of light-emitting elements. Light source 20 may be used as a light source 12 in the apparatus of FIG. 3, for example. In the illustrated example, light source 20 has interspersed arrays of red-, green- and blue-emitting light emitting elements 21A, 21B and 21C (collectively RGB light emitting elements 21). RGB light emitting elements 21 may comprise LEDs, for example. In such embodiments, the LEDs may comprise discrete devices or parts of larger components on which multiple LEDs are formed. The LEDs may comprise organic LEDs (OLEDs) in some embodiments. Light source 20 also comprises an array of white light emitting elements 23. In the illustrated embodiment, elements 23 are distributed among RGB light emitting elements 21. White light emitting elements 23 may comprise white-emitting LEDs, for example.

For convenience of illustration, light source 20 is illustrated as having equal numbers of each type of RGB light emitting elements 21 and white light emitting elements 23. This is not mandatory. Some of the types of light source may be distributed more densely than others over light source 20. For example, RGB light emitting elements 21 may be distributed in the general manner described in PCT patent application No. PCT/CA2004/002200 published as WO2006/638122, which is hereby incorporated herein by reference.

Figure 5:
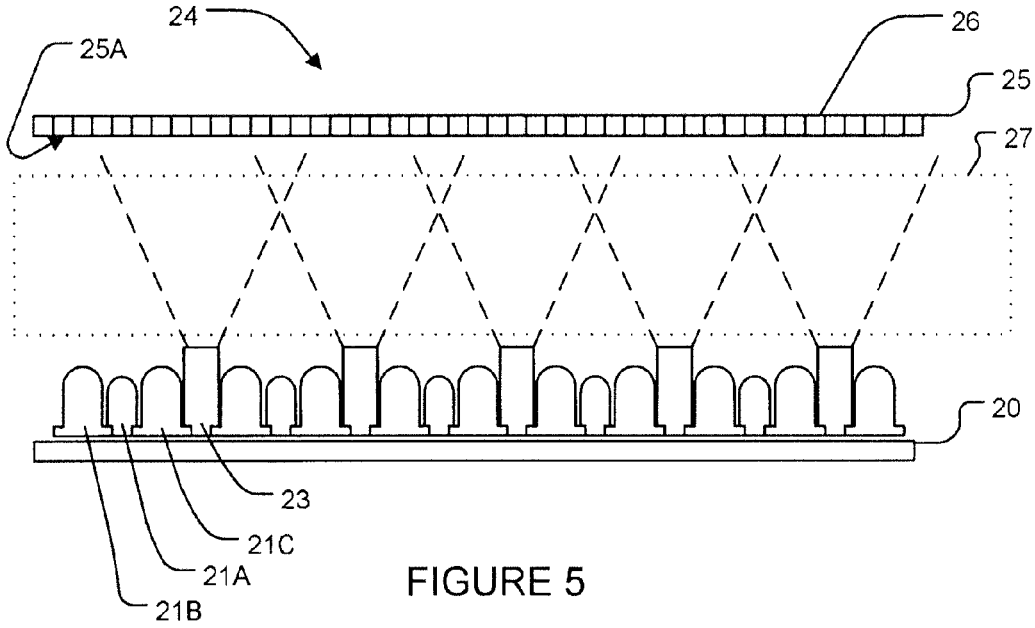
FIG. 5 is a schematic cross section through a portion of a display incorporating a backlight having narrow-band and broadband light emitters.

FIG. 5 shows an example display 24 in which light source 20 is configured as a backlight for a transmission-type spatial light modulator panel 25 having addressable pixels 26. Light from light source 20 impinges on a face 25A of panel 25 after passing through region 27. In the illustrated embodiment, light from each of the light emitters of light source 20 spreads according to a point-spread function dependent on the characteristics of the light emitter as well as the characteristics and geometry of region 27.

Light from nearby light emitters of each type can overlap at panel 25 such that each pixel 26 of panel 25 can be illuminated by light from at least one light emitter of each type. In some embodiments the point spread functions of the light emitters are broad enough and the spacing of the light emitters is close enough that each pixel 26 of panel 25 can be illuminated by at least two light emitters of each type of narrow-band light emitter (in the illustrated embodiment, each type of RGB emitters 21). In the illustrated embodiment, each light emitter of light source 20 can illuminate multiple pixels 26 of panel 25.

Figure 5A:
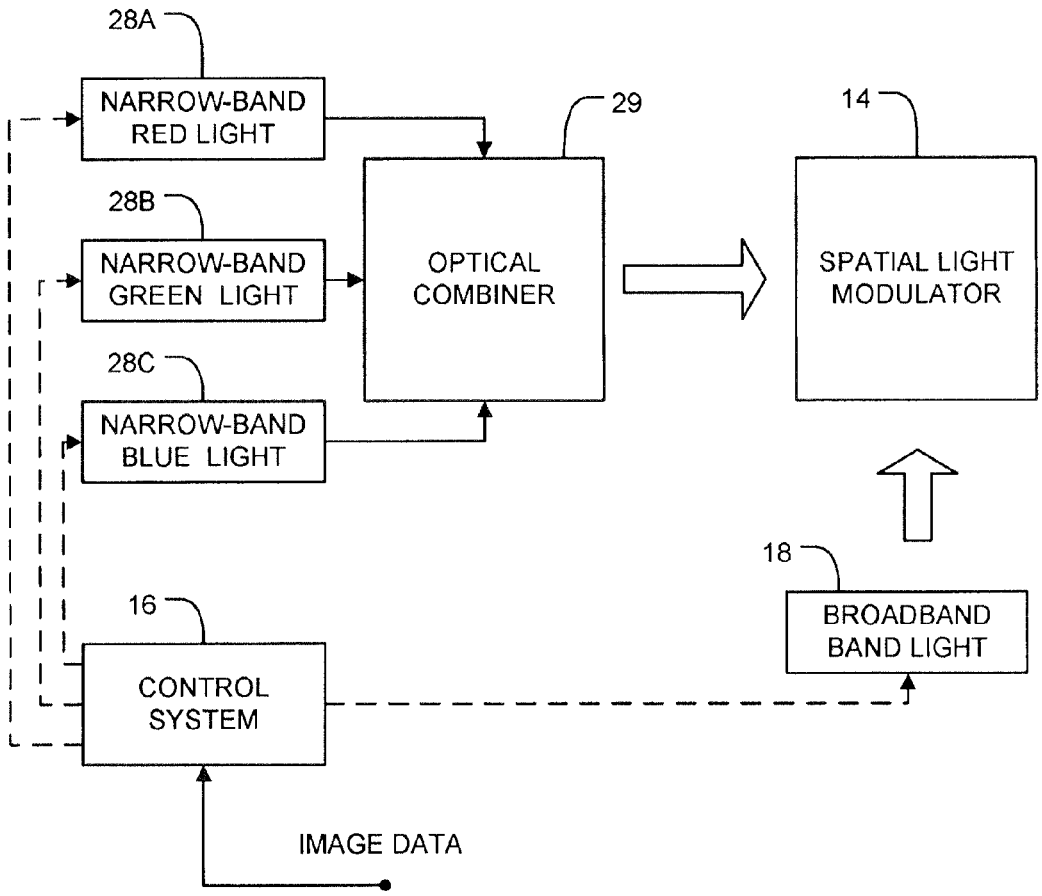
FIG. 5A is a block diagram of a display according to another example embodiment.

It is not mandatory that the light-emitters of the different types of light-emitters are interspersed on a common substrate or in a common plane. In alternative embodiments separate arrays of light-emitters of one or more different types are provided and patterns of light from the separate arrays are combined upstream from or at spatial light modulator 14. FIG. 5A illustrates one example embodiment wherein light from narrow-band light emitters 28A, 28B and 28C is combined at an optical combiner and delivered to illuminate spatial light modulator 14. Light from broadband light source 18 also illuminates spatial light modulator 14.

Narrow-band light emitters 28A, 28B and 28C may comprise separate arrays of narrow-band light emitters, for example. In other example embodiments:

two or more types of the narrow-band light emitters are interspersed in one array and the resulting light is combined with light from one or more other types of the narrow-band emitters before passing to spatial light modulator 14;

light from broadband light source 18 is combined with light from one or more other types of the narrow-band emitters before passing to spatial light modulator 14;

broadband light emitters and one or more types of the narrow-band light emitters are interspersed in one array and the resulting light is combined with light from one or more other types of the narrow-band emitters and/or one or more other types of broadband light emitters before passing to spatial light modulator 14.

Figure 5B:
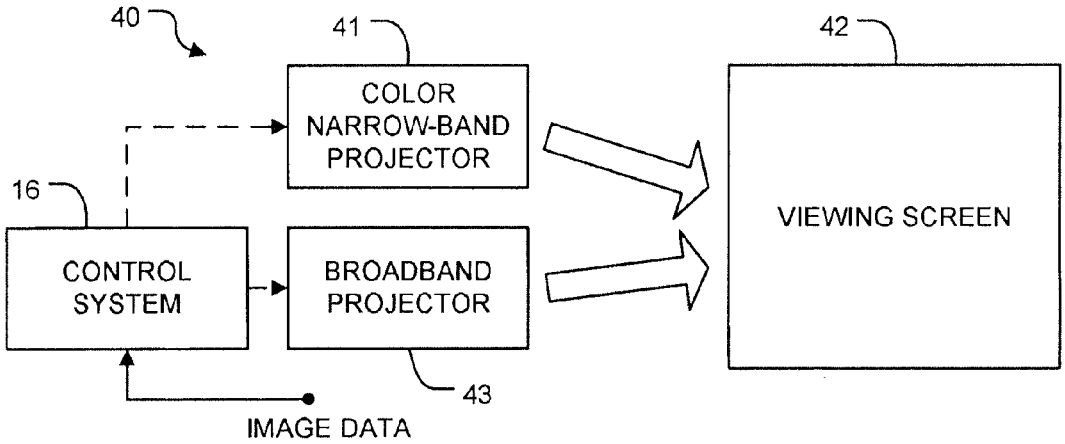
FIG. 5B is a block diagram of a display according to another example embodiment.

FIG. 5B is a block diagram illustrating a display 40 according to another example embodiment. Display 40 has a color narrow-band projector 41 arranged to project an image onto a viewing screen 42. Screen 42 may comprise a front- or rear-projection screen of any suitable type. Screen 42 may be built into a common housing with projector 41 or may be separate. Color narrow-band projector 41 may comprise any known projector construction in which an image made up of narrow-band light is projected onto screen 42. In some embodiments, projector 41 comprises the optics of a laser projector. In some embodiments projector 41 comprises one or more spatial light modulators to imagewise modulate light from suitable narrow-band light emitters. In some embodiments, projector 41 scans one or more beams of light onto screen 42.

A broadband projector 43 is also arranged to project light onto viewing screen 42. The light projected by projectors 41 and 43 is combined at screen 42 so that the light reaching a viewer from any location on screen 42 is a combination of the narrow-band light from projector 41 and broadband light from projector 43. A controller 16 receives image data and controls the light projected by the narrow-band projector 41 and broadband projector 43 so that the combined light from the two projectors yields a desired image when viewed by a viewer. Controller 16 controls the relative amounts of broadband and narrow-band light projected onto each location on screen 42 as described herein. Display 40 may be capable of reducing the amount of broadband light at some locations on screen 42 to provide highly saturated colors and increasing the proportion of broadband light at other locations of screen 42 to provide flesh tones and other colors for which metameric failures are reduced when images projected on screen 42 are viewed by a wide cross section of viewers.

Broadband projector 43 has a spatial resolution significantly lower than that of color projector 41 in some embodiments. For example, the spatial resolution of broadband projector 43 is a factor of 2 to 20 smaller in each direction than that of color projector 41 in some embodiments. In alternative embodiments of display 40 the broadband light (which could comprise white light) is introduced into the optical path of projector 41 upstream from screen 42.

Figure 6:
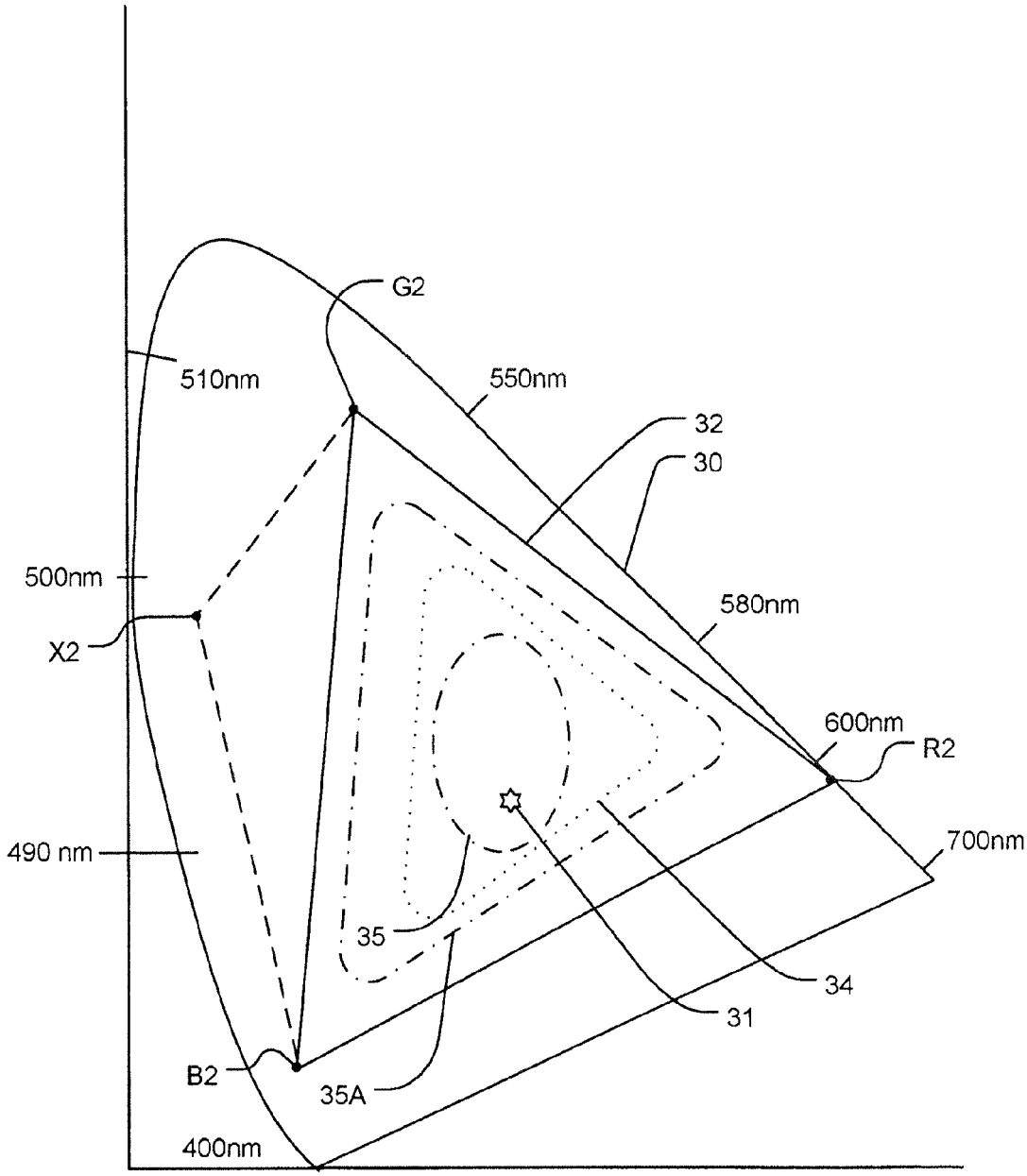
FIG. 6 is a CIE chromaticity diagram illustrating schematically control regions that may be applied for controlling light sources in example embodiments.

FIG. 6 shows a CIE chromaticity diagram. Curved boundary 30 encompasses the colors that can be perceived by the HVS (of a 'standard observer'). Point 31 indicates achromatic light. Triangle 32 encompasses a color gamut that can be generated by narrow-band light sources emitting light having chromaticities R2, G2 and B2. As indicated by the dashed lines 32A, the color gamut can be increased by adding light sources of one or more additional primary colors. An optional additional set of light sources capable of emitting light of chromaticity X2 is indicated in FIG. 6. It can be seen that the addition of light sources of chromaticity X2 increases the gamut from triangle 32 to the polygon having vertices at R2 G2, B2, and X2 (see FIG. 6).

Also shown schematically in FIG. 6 is a limited gamut 34 of colors that can be accurately reproduced by panel 25 if illuminated only by light from broadband light emitters 23. The size of gamut 34 is, in general, a function of luminance. The shape of the boundary of gamut 34 depends upon the spectrum of light from the broadband light emitters. The illustration of gamut 34 in FIG. 6 is schematic. In the illustrated embodiment, gamut 34 is contained entirely within triangle 32 which corresponds to a gamut of colors that can be accurately reproduced by panel 25 if illuminated only by light from narrow-band light emitters of chromaticities R2, G2 and B2.

Figure 7:
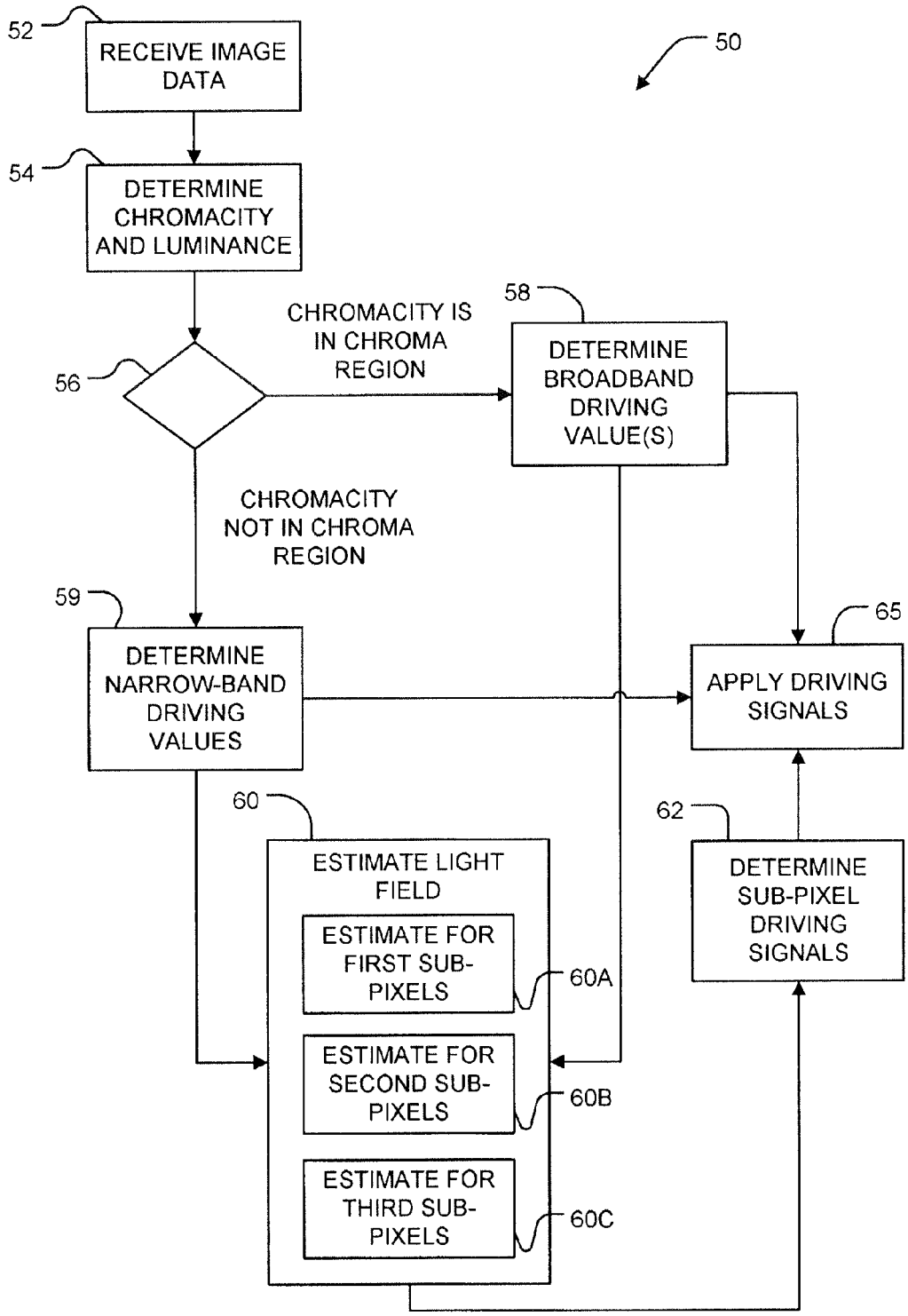
FIG. 7 is a flow chart illustrating a method according to an example embodiment.

One aspect of this invention provides a method 50 as illustrated in FIG. 7 that may be implemented in control system 16. Method 50 receives image data in block 52 and in block 54 method 50 determines from the image data a chromacity and luminance specified for an area of an image to be displayed. The area comprises a pixel or group of pixels of the image to be displayed. Block 54 is performed for each area of the image to be displayed. In some embodiments, the image is subdivided into a plurality of areas each comprising a plurality of pixels and block 54 is performed for each of the areas.

In some embodiments each area of spatial modulator 14 being considered comprises multiple image pixels. In such embodiments single chromaticity and luminance values representing the area may be obtained in a variety of ways. For example, a representative luminance may comprise:

luminance averaged over the pixels of the image area;

a maximum luminance of the pixels in the image area;

a weighted average of luminance values for pixels in the image area wherein brighter pixels and/or pixels in contiguous groups with other pixels of similar brightness are weighted more heavily while dimmer pixels and/or isolated pixels are weighted less heavily.

Representative luminance may be determined separately for each of a plurality of color bands corresponding to sub-pixels of spatial light modulator 14.

A representative chromaticity may be obtained in a variety of ways. For example, a representative chromaticity may comprise:

chromaticity averaged over the pixels of the image area;

a weighted average of chromaticity values. In the weighted average, pixels having more highly saturated chromaticities and/or pixels located in contiguous groups with other pixels having similar chromaticities may be weighted more heavily than other pixels.

In block 56 method 50 determines for each area whether or not the chromacity falls within a chroma region. The chroma region may correspond to gamut 34 or may be a region within gamut 34. The chroma region includes achromatic point 31 in preferred embodiments.

In various embodiments, the determination of block 56 is based at least on:

chromacity; or chromacity and luminance.

Where the determination in block 56 is based on luminance then, in some embodiments, the chroma region is defined based at least in part on the luminance (for example: different chroma regions may be used for different luminance ranges; a prototype chroma region may be scaled in response to a luminance value; or a boundary of the chroma region may be defined based at least in part on a luminance value) and then the chromacity is compared to the chroma region. Defining the chroma region may comprise, for example:

retrieving one of a plurality of predefined chroma regions based at least in part on the luminance;

modifying a boundary of a prototype chroma region in a manner that is a function of the luminance;

generating a chroma region as a predetermined function of the luminance.

FIG. 6 shows schematically a chroma region 35. In some embodiments, chroma region 35 is selected such that whether or not a particular chromaticity (as determined in block 54) falls within or outside of chroma region 35 can be determined with simple logic and/or simple computations. For example, chroma region 35 may comprise a region defined by:

inequalities of CIE chromaticity values x and y (e.g. $x1 \leq x \leq x2$ and $y1 \leq y \leq y2$ where x1, x2, y1, and y2, are predetermined values);

inequalities of a function of CIE chromaticity values x and y (e.g. $|x^2+y^2| \leq R$ where R is a predetermined value);

inequalities of coordinates or functions of coordinates in another color space such as an RGB, CIELUV, CIEXYZ, CIEUWV, CIELAB, YUV, YIQ, YCbCr, xvYCC, HSV, HSL, NCS etc. color space;

etc.

In some embodiments one or more lookup tables are provided and determining whether or not a chromaticity corresponding to an image area falls within a chroma region comprises looking up a value from the lookup tables using one or more chromaticity coordinates.

If block 56 determines that the chromacity for an image area does fall within the chroma region then, in block 58, a driving value is determined for one or more broadband light emitters 23 that correspond to the area. If block 56 determines that the chromacity falls outside of the chroma region then, in block 59 driving values are determined for the plurality of narrow-band light emitters 21 that correspond to the area. As described below, in other embodiments for areas having some chroma values, driving values are determined for both narrow-band light emitters 21 and broadband light emitters 23.

Based on the driving values determined in blocks 58 and/or 59, block 60 estimates a light field at panel 25. Separate light fields are estimated for spectral ranges corresponding to each color of sub-pixel in panel 25 as indicated by blocks 60A through 60C. Where panel 25 has more than three types of sub-pixel (for example where panel 25 is a RGBW panel or a RGBY panel) then more light fields may be estimated in block 60. The estimated light fields may comprise maps that specify luminance values at the locations of sub-pixels of panel 25. In some embodiments, estimating each light field comprises estimating contributions to the light field from one type of the narrow-band light emitters corresponding to the light field and from the broadband light-emitters.

A light field may be estimated by determining and summing light from individual contributing light-emitters for a plurality of locations on spatial light modulator 14. The contribution made by an individual light-emitter to different areas on spatial light emitter 14 may be estimated based on a driving value with which the light emitter is to be driven, a predetermined relationship between light output and the driving value and on a point-spread or other similar function that represents how light from that light emitter is distributed over spatial light modulator 14. By way of example only, the light field may be estimated in a way like that described in PCT application No. PCT/CA2005/000807 published under No. WO 2006/010244 and entitled RAPID IMAGE RENDERING ON DUAL-MODULATOR DISPLAYS which is hereby incorporated herein by reference.

In block 62 driving signals are determined for each of the sub-pixels in panel 25. The driving signals may be determined, for example, by dividing a desired luminance for the sub-pixel (the desired luminance is determined from image data defining an image to be displayed) by the value of the light field corresponding to the sub-pixel's type (e.g. red, blue or green) at the location of the sub-pixel.

In block 65 the driving signals determined in block 62 are applied to the sub-pixels of panel 25 and the driving signals determined in blocks 58 and/or 59 are applied to drive light source 20. This results in the desired image being displayed to a viewer. Portions of the image can have highly-saturated reds, blues or greens (in such portions the broadband light source(s) contribute relatively little light). Other portions of the image can include a significant amount of broadband light.

Blocks 58 and 59 may comprise applying spatial and/or temporal filters in order to avoid visible artefacts resulting from factors such as:

lines along which the illumination of panel 25 changes sharply;

sudden temporal changes in the illumination of individual areas of panel 25;

illumination of areas of panel 25 being too bright for sub-pixels in the areas to attenuate the light to desired levels;

etc.

The filters comprise suitable digital filters in some embodiments.

In method 50 each area of panel 25 is illuminated primarily either by light from broadband light emitters or by light from narrow-band light emitters. In some embodiments, light from broadband light emitters is blended with light from narrow-band light emitters with the balance of light from broad- and narrow-band light emitters being determined at least in part on the basis of: the desired color; or the desired color and desired intensity for a corresponding area of the image to be displayed.

In some embodiments, such blending is performed when the chromaticity for an area of an image is outside of a first chroma region (e.g. chroma region 35 of FIG. 6) and inside another chroma region (e.g. chroma region 35A of FIG. 6). FIG. 6 shows chroma regions 35 and 35A as having different shapes but this is not mandatory. In some embodiments, such blending is performed for all colors.

In an example embodiment, C1 is a first chroma region and C2 is a second chroma region and $C1 \subset C2$. If for an area the representative chromaticity (as determined for example in block 54) is given by c then:

$ if $c \in C1$ generate driving signals only for the corresponding broadband light sources;

$ if $c \in C2$ and $c \notin C1$ then generate driving signals for both the corresponding broadband light sources and the corresponding narrow-band light sources; and, $ if $c \notin C2$ generate driving signals for the corresponding narrow-band light sources only.

In some embodiments, an area of C1 is at least ½ of an area of C2.

Blending may be performed non-linearly such that it is perceptually smooth. In some embodiments, the relative amount of broadband light to narrow-band light is determined at least in part based upon the size of the MacAdam ellipse (or equivalent where chromaticity is defined on coordinates other than CIE x y values) for the given chromaticity. For chromaticities for which the MacAdam ellipse is larger (meaning that the HVS is less sensitive to changes in chromaticity) more broadband light may be provided than for chromaticities for which the MacAdam ellipse is smaller (meaning that the HVS is more sensitive to changes in chromaticity). Because luminance and chromaticity can be corrected on a pixel-by-pixel basis by suitably setting values for the sub-pixels of spatial light modulator 14, it is not mandatory that the blending be precise. A function that to first order is proportional to the size of MacAdam ellipses could be applied in determining the relative amounts of broadband and narrow-band light to blend in an area of spatial light modulator 14 corresponding to a particular area of an image to be displayed.

In some embodiments, the amount of broadband light to be blended with narrow-band light is determined based on a distance from a reference point within gamut 34 to the representative chromaticity of the area in question. The reference point may conveniently correspond to achromatic point 31. The proportion of broadband light may be a function of the distance from the reference point that drops off monotonically with distance from the reference point or remains fixed (in some embodiments fixed at 100%) up to a first distance from the reference point and then drops off monotonically with increasing distance from the reference point.

In some embodiments the amount of broadband light to be blended with narrow-band light is also based on luminance (or brightness) of the area (for example the representative luminance as described above). Above a threshold brightness (the threshold may be a function of chromaticity) the amount of broadband light to be blended with narrow-band light for a particular image area may be increased.

In some embodiments, the amount of broadband light to be blended with narrow-band light is based on a saturation index for each primary color (e.g. for each set of narrow-band light emitting elements). For each primary color, the saturation index is essentially a measure of how closely light of the primary color alone matches the chromaticity for the area). If the saturation index for one primary color is relatively high (e.g. above a threshold) then the amount of broadband light to be blended with narrow-band light for an area may be made small or none. If the saturation indices for all of the primary colors are relatively low (e.g. below a threshold or below corresponding thresholds for the different colors) then the amount of broadband light to be blended with narrow-band light for the area may be made large (up to 100%).

Figure 8:
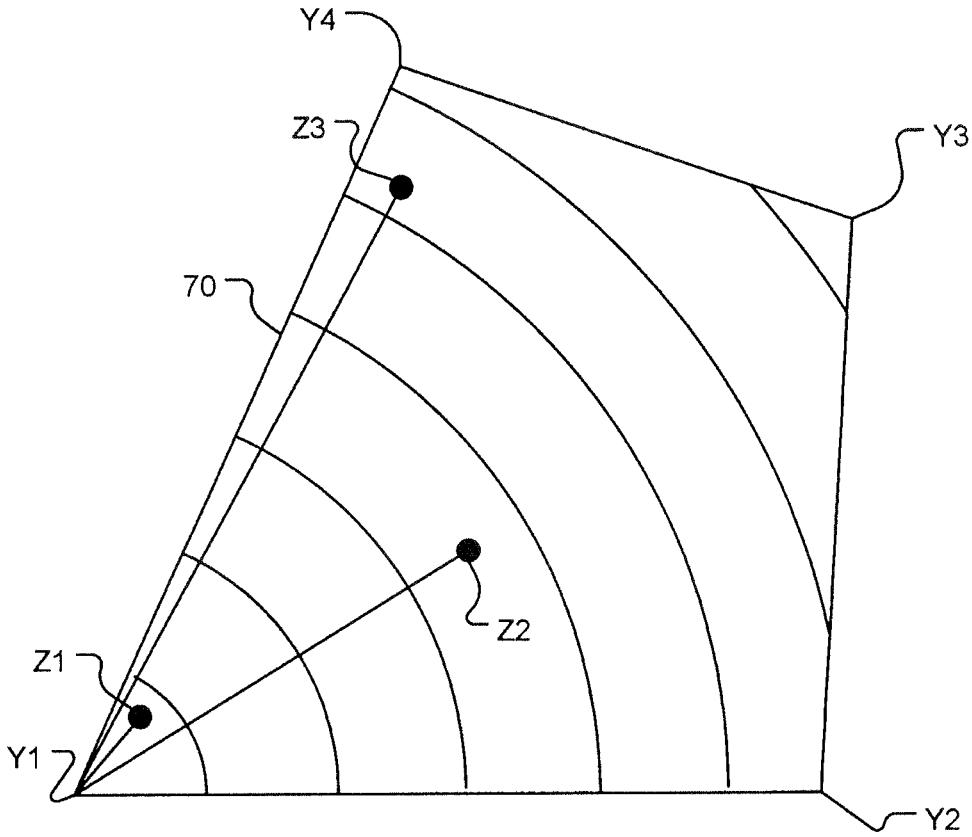
FIG. 8 is a schematic view of a gamut in an arbitrary color space indicating example saturation indices for one primary color.

By way of example, FIG. 8 shows a color gamut 70 in some two-dimensional color space defined by four primary colors Y1 through Y4. Chromacities Z1 through Z3 are marked within gamut 70. For primary color Y1, Z1 has a high saturation index (to make Z1 using the primaries Y1 through Y4 one would use a lot of Y1 and not very much of all of the other primaries combined). On the other hand, Z2 and Z3 have much lower saturation indices for primary color Y1. Z3 is close to primary color Y4 and therefore has a relatively high saturation index for primary color Y4. Z2 has a relatively low saturation index for all of primaries Y1 through Y4.

Figure 9:
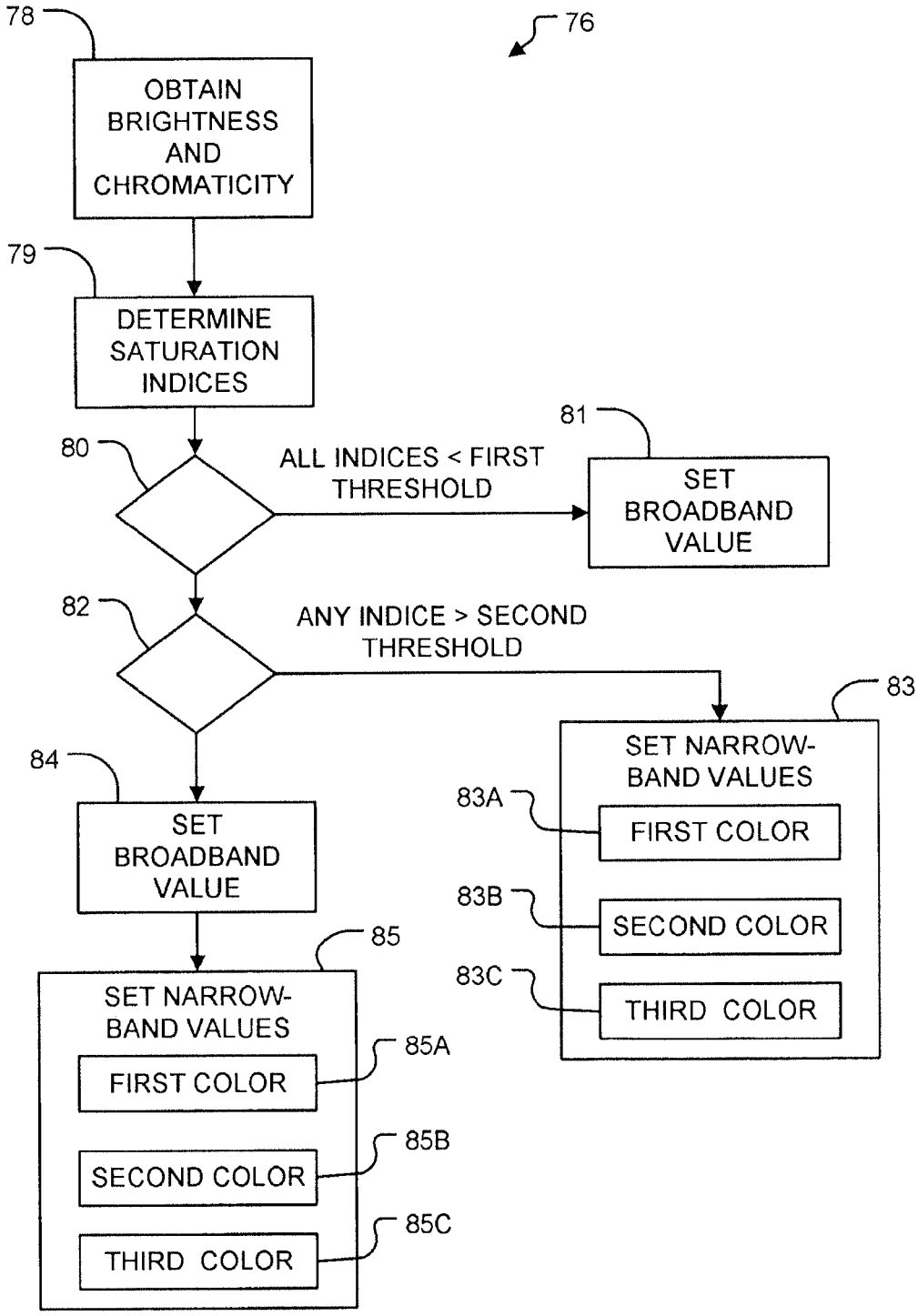
FIG. 9 is an example method for setting values for driving light sources based on saturation indices.

FIG. 9 shows an example method 76 for determining a desired amount of light for an area from each of a plurality of types of narrow-band light emitters and a broad-band light emitter. At block 78, method 76 obtains chromaticity and brightness information for the area. At block 79 a saturation index is determined for primary colors corresponding to each of the plurality of types of narrow-band light emitters. At block 80, the saturation indices are compared to a first threshold. If all of the saturation indices are below the first threshold then at block 81 a value is set for the broadband light emitters. Block 81 may comprise determining separately for spectral ranges corresponding to each color of sub-pixels of spatial light modulator 14 how much light in that spectral range is required to replicate an image to be displayed. The required amount of light may be determined by: considering the observed intensities specified by image data; and applying known characteristics of the spectrum of the broadband light to determine how intense the broadband light should be to provide at least the required amount of light in each spectral range.

Otherwise method 76 proceeds to block 82 which compares the saturation indices to a second threshold greater than the first threshold. If one of the saturation indices is above the second threshold value then, method 76 proceeds to block 83 comprising blocks 83A through 83C which determine values for each type of narrow-band emitter.

Otherwise method 76 proceeds to block 84 which determines an amount of broadband light to apply. This may be done in various ways including:

- Proceeding in the manner described above for block 81 and then reducing the amount of broadband light by a factor. The factor may be based on one or more of the saturation indices. The factor may be based, for example, on: a highest one or more of the saturation indices; an average of the saturation indices; or the like;
- Proceeding as described above for block 81 but not taking into account: light for the primary color having the highest saturation index; or alternatively not taking into account light for a plurality of primary colors having the highest saturation indices; or alternatively taking into account only light for primary colors having the lowest saturation indices or the like and optionally reducing the amount of broadband light by a factor. The factor may be based on one or more of the saturation indices.
- Applying a predetermined amount of broadband light;
- etc.

Block 85, comprising blocks 85A through 85C, determines the amount of light to be added for each type of narrow-band emitter. Block 85 may comprise, for example, determining values for each type of narrow-band emitter without reference to the broadband light and then from each of the determined values subtracting an amount of light in the corresponding wavelength range contributed by the broadband light output determined in block 84.

Method 76 may be applied for each of a plurality of areas which cover spatial light modulator 14. Driving values for individual light emitters of each type of narrow-band light emitter and the broadband light emitters may be determined from the results of method 76. These determinations may comprise applying spatial and/or temporal filters, as described above, to avoid noticeable artefacts resulting from illumination levels on spatial light modulator 14 that change abruptly in space or time at locations or times that do not correspond to changes in the image content.

It is not mandatory that the broadband light emitters be controllable with the same intensity resolution as the narrow-band light emitters. For example, where control is exercised by selecting one or more discrete values corresponding to discrete levels of light emission, in some embodiments the broadband light emitters are controllable in fewer discrete steps than the narrow-band light emitters. In some embodiments, broad-band light emitters for each area are controllable to be either on or off.

It is not mandatory that the broadband light emitters be controllable with the same spatial resolution as the narrow-band light emitters. In some embodiments the broadband light emitters are controllable with a significantly lower spatial resolution than the narrow-band light emitters. In an extreme example, the broadband light source illuminates the entire area of spatial light modulator 14 and the amount of broadband light delivered to different areas of spatial light modulator 14 is not independently controllable. In some embodiments, a broadband light source illuminates the entire area of spatial light modulator at a moderate level that is not changed in response to image data. Such embodiments may optionally have one or more other broadband light sources that are controlled (spatially and/or temporally) in response to image data.

In methods according to some embodiments, driving signals are generated for a plurality of types of narrow-band light emitters and at least one type of broadband light emitters that are arranged to illuminate a two-dimensional spatial light modulator. The spatial light modulator comprises a transmissive panel, such as an LCD panel in some embodiments. The light emitters of each type include individually-controllable light emitters. Areas of the spatial light modulator are illuminated to different degrees by different ones of the individually-controllable light emitters. The light emitted by different neighboring ones of the individually-controllable light emitters of each type overlap. Each individually-controllable light emitter comprises one or more devices that emits light. For example, in some embodiments the individually-controllable light emitters comprise LEDs or groups of LEDs.

Figure 11:
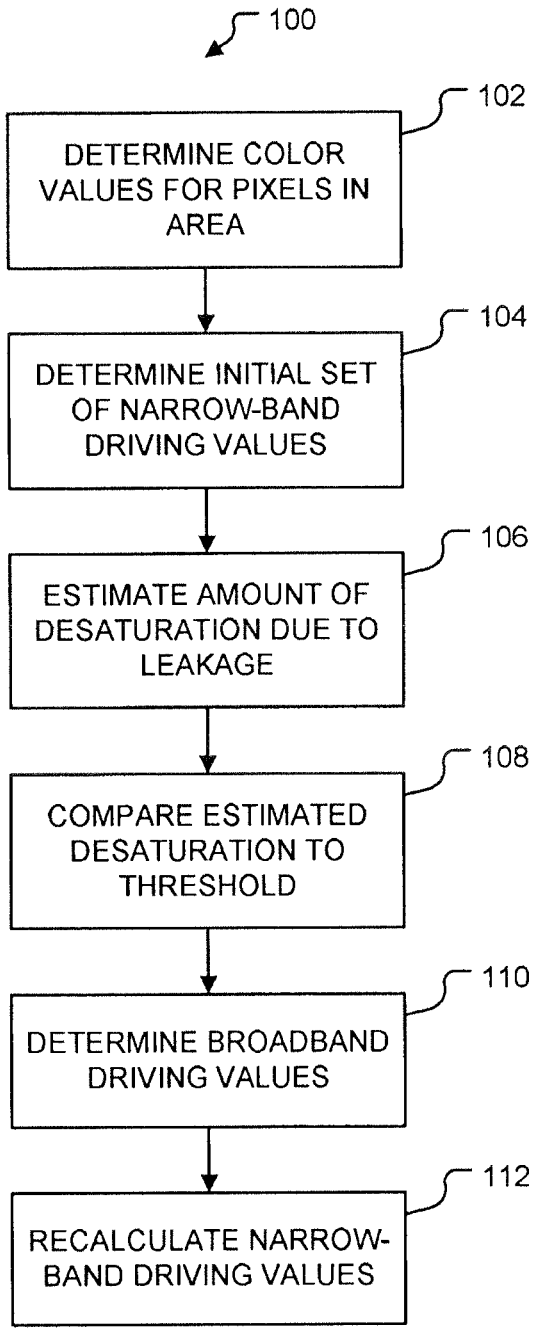
FIG. 11 is a flow chart illustrating a method according to an example embodiment.

FIG. 11 shows an example method 100 for determining driving values for the individually-controllable light emitters comprising the following steps.

For an area of the spatial light modulator, determining color values for pixels within the area (block 102). The color values may comprise values corresponding to the different types of narrow-band light-emitters. For example, the color values may comprise RGB values.

An initial set of driving values for the narrow-band light emitters may then determined from the color values (block 104). The initial set may be established based on maximum values for each narrow-band emitter (e.g. each of R, G and B) within the area or on maximum values for each narrow-band emitter integrated over sub-areas within the area. The area should be illuminated brightly enough by light of each primary color to display the maximum amount of that primary color within the area.

Since light from the narrow-band light emitters falls on all pixels within the area of the spatial light modulator, some colors may be desaturated to some degree by light of other narrow-band light emitters that leaks through the spatial light modulator. Consider the case where an area on an LCD panel should display three adjoining stripes respectively of pure red, pure blue and pure green. The area may be illuminated by narrow-band red, green and blue light sources of sufficient intensity to cause the red, green and blue stripes to each have a desired brightness. In the part of the area occupied by the pure red stripe some of the blue and green light will leak past the spatial light modulator. The amount of leakage will depend upon the pass-bands of filters in the spatial light modulator and other characteristics of the spatial light modulator. The leakage light will cause some desaturation of colors. The amount of desaturation at any pixel can be estimated based upon factors which may include: the brightness of illumination of the spatial light modulator by each of the narrow-band light emitter types at the location of the pixel; filter characteristics of the spatial light modulator; transmission characteristics of the spatial light modulator; etc. Similar estimations may be performed for the other stripes. In general, the amount of desaturation arising from the fact that the color corresponding to light from narrow-band light emitters illuminating any one pixel may be different from the color specified for that pixel may be determined on a pixel-by-pixel basis (block 106).

The estimated desaturation for pixels in the area may then be compared to a threshold (block 108). The threshold may be fixed but can be based upon a function of the degree of saturation of the colors specified for the pixels. If the color specified for a pixel or neighborhood of pixels is highly saturated for some primary color then the threshold may correspond to a small amount of desaturation. If the color specified for the pixel or neighborhood of pixels is not very saturated for any primary color then the threshold may permit a greater degree of desaturation.

The amount of broadband light to be added for the area can then be determined based at least in part on the comparison of the desaturation to the threshold (block 110). Since broadband light is either added for the area, or not, this determination takes into account the comparison for pixels across the area. In some embodiments this is done for all pixels in the area and in others for selected pixels in the area. In some embodiments, a map indicating the comparison of the desaturation to the threshold is low-pass spatially filtered or averaged over areas within the area and an amount of broadband light that can be added without increasing the desaturation of any significant part of the area beyond the threshold is determined.

The amount of light from each type of narrow-band light emitter for the area is recalculated based on the amount of broadband light for the area and the known spectrum of the broadband light (block 112). In some embodiments, each pixel of the spatial light modulator has a plurality of sub-pixels that pass light in corresponding color bands and for each sub-pixel of the spatial light modulator, when the narrow-band and broadband light sources are driven at their corresponding driving values the amount of light incident on the sub-pixel in the corresponding color band is slightly greater than a desired amount as determined from image data such that the light can be modulated to the desired amount by reducing a transmissivity of the sub-pixel by an amount within a range of adjustment of the sub-pixel.

To minimize the potential for observer metameric failures, in a display having controllable broadband and narrow-band light sources it can be desirable to use the broadband light sources primarily. Methods according to embodiments of the invention may be biased toward controlling broadband light sources to generate required light and to use narrow-band light sources where necessary. In such embodiments, where a desired color can be produced by backlighting LCD color pixels with broadband light sources alone, this is done even if the desired color could also be matched by backlighting the LCD color pixels with light from a mix of narrow-band light sources. This reduces the potential for observer metameric failures. If the desired color is a very saturated color, then backlighting by one or more different types of narrow-band light sources is not objectionable and may even be necessary. In such cases, more of, or perhaps only, the narrow-band light sources may be used to backlight the LCD color pixels.

Figure 12:
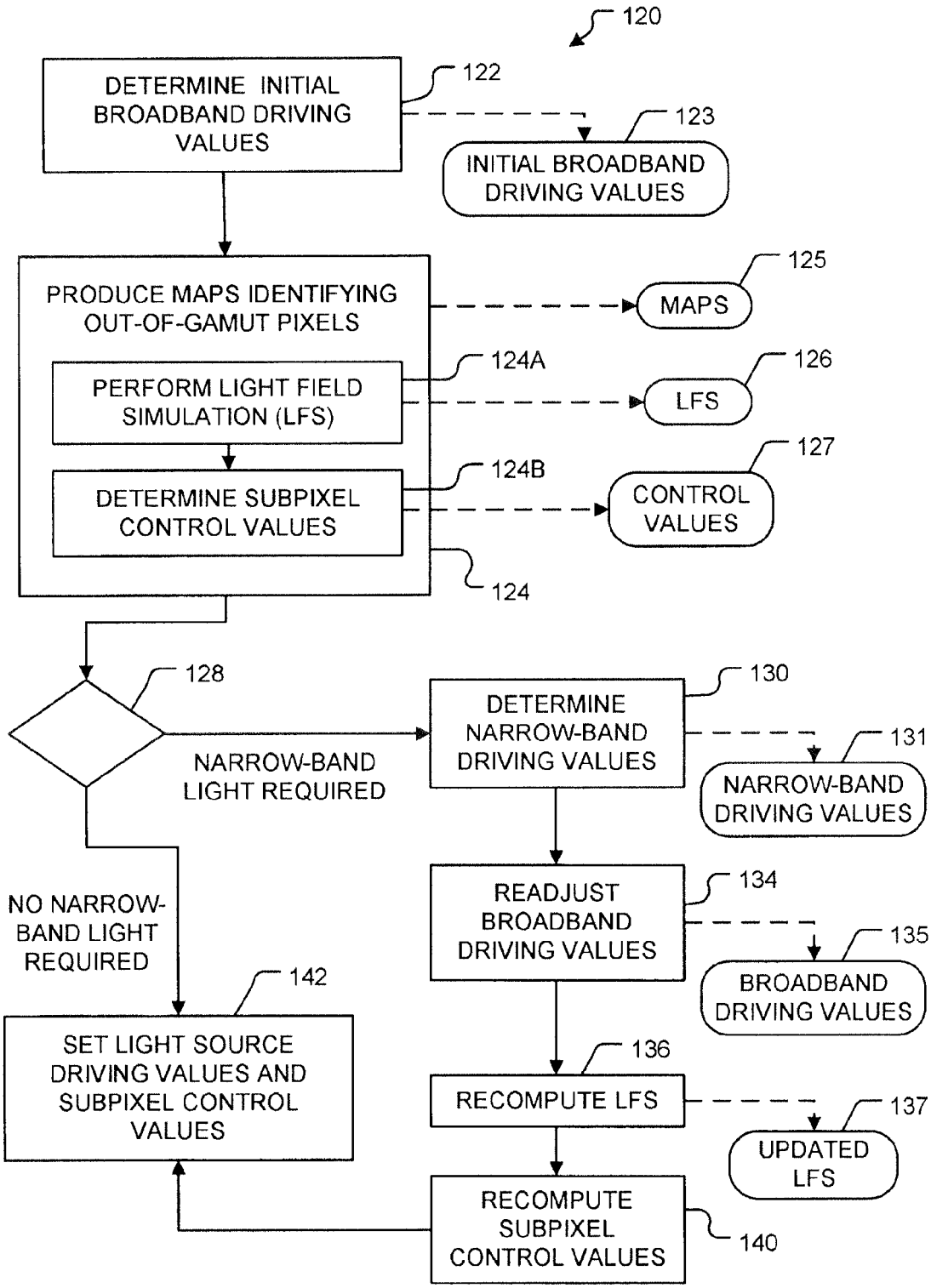
FIG. 12 is a flow chart illustrating a method that includes setting driving values according an example embodiment of the present invention.

FIG. 12 illustrates a method 120 according to another example embodiment. In method 120, driving values are initially established for broadband light sources. Driving values for narrow-band light sources are generate where illumination by one or more narrow-band light sources is required to achieve desired image characteristics. In deciding which (if any) narrow-band light sources to use, method 120 locates pixels which require a local increase in color saturation beyond that achievable by broadband light sources alone.

The example method 120 controls red, green and blue narrow-band light sources, and white broadband light sources that illuminate an LCD panel. In the example, the light sources may comprise LEDs. Block 122 determines initial drive values for the white LEDs. The light values are chosen so that each pixel of the LCD will be illuminated by light of at least a desired luminance (up to the maximum luminance available from the broadband light sources). Block 122 yields initial broadband driving values 123.

Block 124 produces maps 125 identifying any out-of-gamut pixels based on the initial broadband driving values 123 (i.e. pixels at which the resulting broadband light will not be sufficient to accurately depict the color specified for that pixel). The out-of-gamut pixels on maps 125 correspond to areas where backlighting by one or more narrow-band LEDs is required to provide the necessary luminance and saturation at that location. Maps 125 may be generated in various ways. For example, in the illustrated embodiment, maps 125 are obtained by performing a light field simulation (LFS) 126 in block 124A. LFS 126 represents the distribution of the broadband light as specified by the driving signals from block 122 at the pixels of the LCD panel. Block 124B then determines control values 127 for the LCD subpixels that would be required to obtain the illumination specified by image data. In some embodiments the image data is represented by desired CIE XYZ tristimulus values or by color values in another color space or color perception space. A matrix inversion may be used to determine the corresponding LCD subpixel values. In such embodiments, negative LCD subpixel values indicate a pixel location at which the light from the broadband light emitters is not able to achieve sufficient saturation and LCD subpixel values greater than a maximum allowed value (for example 255 where the LCD subpixels have with 8-bit drive resolution) indicates a pixel location with insufficient luminance from the broadband light emission alone.

Block 128 checks maps 125 to determine if the light provided by the broadband light sources will be sufficient to accurately depict the colors specified for all pixels (sufficient luminance and saturation at each pixel location). Where maps 125 have no out-of-gamut pixels then the narrow-band light sources can remain switched off. In this case, at block 142, the initial broadband driving values 123 may be used to drive the broadband light sources and the subpixel control values 127 may be used to drive the subpixels of the LCD panel (as the analysis of maps 125 shows that all desired colors can be produced by the broadband backlight alone). In some embodiments, isolated out-of-gamut pixels or small groups of out-of-gamut pixels are ignored in analyzing maps 125. This may be achieved, for example, by creating a mask identifying locations of out-of gamut pixels and applying a smoothing filter to the mask.

If block 128 determines that narrow-band backlighting is required, then block 130 is executed. Block 130 determines driving values for the narrow-band light sources. The narrow-band driving values may be determined based on the subpixel control values and pixel locations of out-of-gamut pixels in maps 125.

Block 130 sets driving values for one or more types of narrow-band light source. For image areas where maps 125 indicates that the desired luminance at all pixels can be achieved without introducing narrow-band light sources but that higher saturation at certain pixels is required then block 130 may switch on narrow-band light sources corresponding to the area of the types required to achieve the desired saturation levels for pixels in the area. The drive values for the specific narrow-band light sources may be determined based on which saturated colors are required to be introduced and also based on where these saturated primaries are required.

Where maps 125 indicates that increased luminance is required for at least some pixels then block 130 may switch on narrow-band light sources corresponding to the area of a predetermined group of types (which could be but is not necessarily all of the types).

One method that may be applied in block 130 is to reduce the resolution of maps 125 to the spatial resolution of an array of the narrow-band light sources and then drive the narrow-band light sources by the subsequent array of values. The resolution of maps 125 may be reduced by downsampling, for example. To facilitate this, the resolution of the narrow-band light sources may be chosen to be some factor of 2 smaller in both dimensions than the resolution of maps 125. Block 130 yields narrow-band driving values 131.

In block 134 the driving values for the broadband elements is readjusted to take into account the narrow-band light to be added in response to block 130. Block 134 produces readjusted broadband driving values 135.

In block 136 the light field simulation is recomputed for the combination of readjusted broadband driving values 135 and narrow-band driving values 131. Block 136 produces an updated LFS 137. Since performing a light field simulation can be computationally expensive, it can be desirable to perform block 136 by adjusting LFS 126 rather than computing a fresh LFS. This is facilitated by the fact that light contributions are additive.

Updated LFS 137 may be obtained by adding to LFS 126 a contribution made by the narrow-band light sources. If the intensities of any of the broadband light sources were modified in block 134 then the reduction in the contribution by the dimmed broadband light sources may be computed and subtracted from LFS 126 before, after or together with adding the contribution from the narrow-band light sources.

In block 140 the LCD subpixel values required to achieve a target image are determined based on image data and updated LFS 137. In some embodiments, LFS 137 is expressed in tristimulus values XYZ. Block 140 may comprise, for example performing a matrix inversion operation based on LFS 137. At block 142, the computed narrow-band driving values 131, broadband driving values 135 and subpixel control values 140 are applied to their respective components to produce the desired image.

In general, the color of the light illuminating the LCD panel can vary over the area of the panel, especially with the addition of light from narrow-band light sources. To obtain 'perfect' results one could perform a unique matrix inversion corresponding to each pixel location. However if the backlight color does not vary significantly over a region of the display area, or if the backlight color is determined to be constant except for luminance variation, then the computational efficiency can be improved.

To improve the efficiency with which LCD subpixel values are determined, out-of-gamut pixel maps 125 can be used to identify image areas where broadband light sources are used and narrow-band light sources are added and mixed with the broadband backlight. Effectively, maps 125 can be used to locate backlight color variations where more local computation is necessary for color accuracy. For areas where the broadband light sources are used only, the color is most likely constant but the luminance may vary. The matrix inversion process required for determining LCD pixel values in such a region can be done quickly as only a single matrix inversion is necessary for all pixels in the region. The pixels within such region may only need to be updated by the typical process of dividing the desired luminance by the luminance achieved as estimated by the LFS. Even within a region where the narrow-band light sources are added and where some of the broad-band light sources are reduced, fewer matrix inversions than on a per-pixel basis can be used to quickly obtain acceptable subpixel values. At the transitions between regions of broad-band backlight only and where narrow-band light sources are added, as can be identified in the out-of-gamut pixel maps, the matrix inversions can be locally determined accurately or be approximated by averaging of large regions constant matrix inverses.

Specific Example

As an example of the application of method 120 consider the case where the out-of-pixel maps 125 show that all pixels are lacking saturated red (this could be the case, for example if the broadband light sources comprise yellow-phosphor-converted white LEDs). To compensate for this lack, some red LEDs (more generally narrow-band red light sources) can be switched on. The intensity and locations where the narrow-band red light sources should be turned on may be determined based on the magnitude and the spatial distribution of the values in out-of-gamut pixel maps 125. The driving values for the narrow-band red light sources may be obtained, for example, by downsampling the red component of out-of-gamut pixel maps 125. As the red light sources also contribute to the luminance, the intensity of the broadband backlight may be reduced somewhat to maintain the desired luminance. The additional LFS contribution by the red LEDs can be added to the precomputed LFS. Any reduced LFS contribution by the dimmed white LEDs (more generally broad-band light sources) may be subtracted from the previously determined LFS. Out-of-gamut pixel maps 125 may be applied to identify locations where color variations can be expected in the light illuminating the LCD panel (and where it may therefore be desirable to perform local calculation of inversion matrices.

In some cases the native gamut achievable using only the broadband light sources is smaller than would be desired. In some embodiments driving signals proportional to the driving signals for broadband light sources are automatically provided to some or all of the narrow-band light sources. This enlarges the native gamut. Since the narrow-band light sources can be driven independently from the broadband light sources, pure saturated colors can be achieved when desired. The algorithm to control a display with such an alternative configuration is similar to the illustrated algorithm example except every that the driving signals for the broadband light sources also turns on corresponding narrow-band light sources by some proportional amount. The proportion may be specified by a fixed or adjustable parameter. In some embodiments, the parameter is set automatically in response to analysis of image data. For images having many pixels outside a native gamut of the broadband light sources the parameter may be increased. The ratio of the amounts amongst the narrow-band light sources is preferably set to match the native white point of the broadband light sources or selected to bias the white point to a desired point.

Methods as described above may be implemented in real time by providing suitable hardware configured to perform the methods. The hardware may comprise one or more programmed data processors of any suitable types, suitable logic circuits (configurable or hard-wired or a combination thereof) or the like. Hardware configured to perform the method may be included in an image processing component for a television, computer display, or the like.

Figure 10:
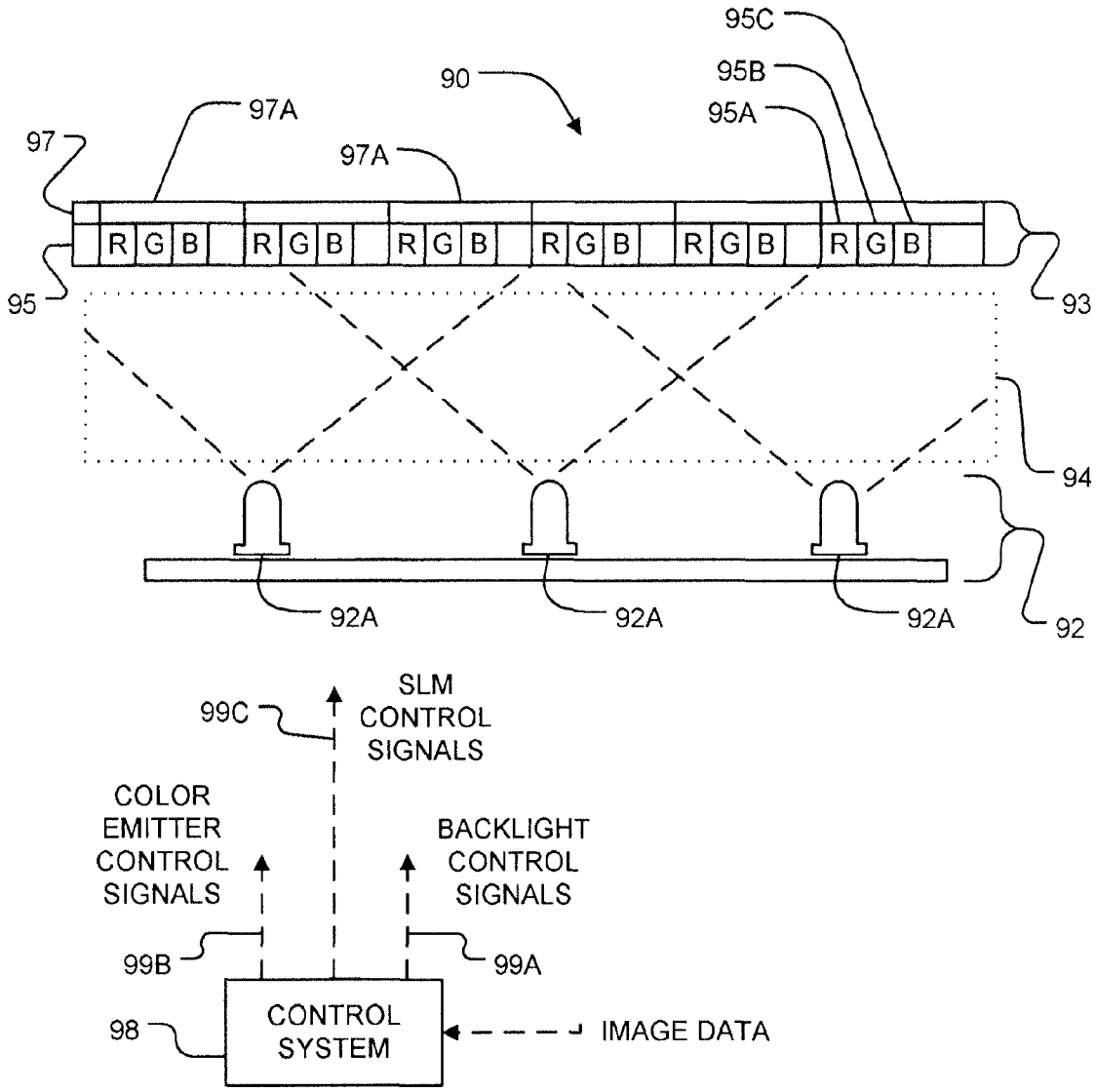
FIG. 10 is a schematic cross section through a portion of a display according to another embodiment.

FIG. 10 shows a portion of a display 90 according to another embodiment of the invention. In this embodiment, broadband light emitting elements are on a different plane from narrow-band light emitting elements. Display 90 comprises a backlight 92 comprising an array of individually-controllable broadband light emitters 92A. Broadband light-emitters 92A may comprise individual LEDs or groups of LEDs for example. Light from backlight 92 propagates to a face of a display panel 93 by way of an optical transmission path 94.

Panel 93 comprises a light-emitter layer 95 and a spatial light modulator layer 97 comprising pixels 97A. Light-emitter layer 95 comprises groups of narrow-band light emitters 95A, 95B and 95C that emit light of different primary colors (for example red green and blue) into pixels 97A. Light issuing from any pixel 97A is a mixture of light from backlight 92 and from those of light emitters 95A, 95B and 95C that illuminate the pixel 97A. The amount of that light that is passed to a viewer may be adjusted by controlling the optical transmissivity of pixel 97A and/or by using pixel 97A as a shutter and varying the amount of time that pixel 97A remains open in any cycle. In some embodiments, pixel 97A comprises a plurality of sub-pixels and the sub-pixels are operable to control an amount of light transmitted by controlling the optical transmissivities of the sub-pixels and/or by using the sub-pixels as shutters and varying the amount of time that each sub-pixel remains open in any cycle.

A control system 98 receives image data and generates backlight control signals 99A for controlling light emitting elements of backlight 92, color emitter control signals 99B for controlling the light emitting elements of panel 93 and SLM control signals 99C for controlling the pixels of panel 93.

In some embodiments one or more additional factors are taken into account in controlling the narrow-band and broad-band light sources of a display. For example, system energy efficiency may be a trade-off parameter. To produce some colors, much of the light emitted by a broadband light emitter may need to be blocked by a spatial light modulator. For example, if the broadband light source illuminates an LCD panel; with white light and it is desired that an area of an image be red then the LCD panel must block the green and blue components of the white light for that area of the image. This reduces overall system energy efficiency. In some embodiments a controller is configurable to decrease the relative amounts of broad-band and narrow-band lighting for image areas having colors such that much of the light from the broadband light source would need to be blocked. In other words, while a color may be producible with broadband light sources alone, some narrow-band light sources may be used to improve the system efficiency by reducing the required absorption by the LCD without neglecting the potential for metameric failure.

Aspects of the invention may be applied in a wide range of contexts. Some examples of such contexts are:

- Broadband light from one or more broadband light sources may be added to laser-based displays such as front- or rear-projection televisions or cinema displays that use laser or other narrow-band light sources. The spatial distribution of broad-band light may be controlled according to methods as described herein, for example.
- OLED displays having RGBW OLED light emitters (or a combination of other narrow-band primary color OLED light emitters with one or more broadband light emitters) may be controlled according to methods as described herein.

One or more broadband light sources may be added into the optical path of other color displays in which illumination is provided by narrow-band light sources.

The invention may be embodied in a variety of ways including, without limitation:

a display incorporating narrow-band primary light-emitters and one or more broad-band light emitters;

a controller for a display having narrow-band primary light-emitters and broad-band light emitters;

an image processing component or sub-system for use in televisions, digital cinema projectors, computer displays, or the like;

a tangible storage medium containing computer instructions that can cause a data processor in a control for a display to perform a method according to the invention;

a method for displaying images using light from narrow-band primary light-emitters and one or more broad-band light emitters;

apparatus having new and inventive features, combinations of features or sub-combinations of features as described herein;

useful methods comprising new and inventive steps, acts, combinations of steps and/or acts or sub-combinations of steps and/or acts as described herein.

Certain implementations of the invention comprise computer processors which execute software instructions which cause the processors to perform a method of the invention. For example, one or more processors in a control system for a display may implement the methods of FIGS. 7 and/or 9 or other methods as described herein by executing software instructions in a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, EPROMs, EEPROMs, flash RAM, or the like. The computer-readable signals on the program product may optionally be compressed or encrypted.

Where a component (e.g. a software module, processor, assembly, device, circuit, etc.) is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments of the invention.

Thus the present invention may be embodied in numerous forms, the following Enumerated Example Embodiments (EEEs) that are exemplary and illustrative, and not intended to limit any of the preceding discussion and/or claims presented herein now or to be presented with any related follow-on applications, continuations, divisionals, or the like.

EEE1. A display comprising:

a viewing screen;

a plurality of narrow-band light-emitting elements arranged to illuminate the viewing screen with narrow-band light of a plurality of colors;

at least one broadband light source arranged to illuminate the viewing screen with broadband light having a broadband spectral power distribution.

EEE2. A display according to EEE1 wherein the viewing screen comprises a spatial light modulator.

EEE3. A display according to EEE2 wherein the spatial light modulator comprises an LCD panel.

EEE4. A display according to EEE1 comprising means for independently spatially modulating a distribution of the narrow-band light of each of the plurality of colors over the viewing screen.

EEE5. A display according to EEE1 comprising means for spatially modulating a distribution of the broadband light over the viewing screen.

EEE6. A display according to EEE1 comprising a backlight wherein the plurality of narrow-band light-emitting elements are arrayed on the backlight.

EEE7. A display according to EEE1 wherein the broadband light source is controllable to alter an amount of the broadband light at a location on the viewing screen and the display comprises a controller connected to receive image data and configured to:

determine from the image data a chromaticity corresponding to the location on the viewing screen and, based at least in part on the chromaticity, control the amount of the broadband light at the location on the viewing screen.

EEE8. A display according to EEE7 wherein the controller is configured to determine from the chromaticity a saturation index for each of a plurality of primary colors and, based on the saturation indices, control the amount of the broadband light at the location on the viewing screen.

EEE9. A display according to EEE7 wherein the controller is configured to determine whether the chromaticity falls within a chroma region and, if so, suppress illumination of the location with the narrow-band light.

EEE10. A display according to EEE7 wherein the narrow-band light-emitting elements comprise organic LEDs controllable to alter an amount of the narrow-band light at the location on the viewing screen.

EEE11. A display comprising a spatial light modulator comprising an array of controllable pixels;

a light source arranged to illuminate the spatial light modulator, the light source comprising:

a plurality of groups of narrow-band light-emitting elements wherein the narrow-band light emitting elements of each group are capable of emitting narrow-band light of one of a plurality of primary colors defining a color gamut; and at least one broadband light emitting element capable of emitting broadband light; and, a controller configured to control the pixels of the spatial light modulator and the light source according to image data defining an image to be displayed.

EEE12. A display according to EEE11 wherein the narrow-band and broadband light emitting elements are independently controllable.

EEE13. A display according to EEE11 wherein each pixel in the spatial light modulator is illuminated by at least one of the groups of the narrow-band light-emitting elements.

EEE14. A display according to EEE11 wherein the plurality of primary colors of the narrow-band light-emitting elements in each group comprise red, green and blue.

EEE15. A display according to EEE11 wherein the narrow-band light emitting elements comprise light-emitting semiconductor devices.

EEE16. A display according to EEE15 wherein the narrow-band light emitting elements comprise LEDs.

EEE17. A display according to EEE15 wherein the narrow-band light emitting elements comprise lasers or laser diodes.

EEE18. A display according to EEE11 wherein the narrow-band light emitting elements comprise light that has been filtered by narrow-band filters.

EEE19. A display according to EEE11 wherein the narrow-band light emitting elements each emit light that is monochromatic or quasi-monochromatic.

EEE20. A display according to EEE11 wherein the narrow-band light emitting elements emit light having a bandwidth of 50 nm or less.

EEE21. A display according to EEE11 wherein the broadband light emitting elements emit white light.

EEE22. A display according to EEE11 wherein the broadband light emitting elements emit light having a spectral bandwidth at half maximum of at least 150 nm.

EEE23. A display according to EEE11 wherein the broadband light emitting elements emit light having a spectral bandwidth at half maximum of at least 200 nm.

EEE24. A display according to EEE11 comprising two or more types of broadband light emitters, the two or more types of broadband light emitters each configured to emit light having different broadband spectra, wherein light from the two or more types of broadband light emitters is combined at or upstream from the spatial light modulator.

EEE25. A display according to EEE11 wherein the light source comprises a backlight and the plurality of narrow-band and broadband light-emitting elements are arrayed on the backlight.

EEE26. A display according to EEE25 wherein each pixel in the spatial light modulator is illuminated by at least one broadband light emitting element and at least one narrow-band light emitting element of each primary color.

EEE27. A display according to EEE25 wherein each of the narrow-band and broadband light emitting elements illuminates a plurality of the pixels.

EEE28. A display according to EEE25 wherein the backlight comprises separate arrays of light emitting elements of one or more different types, and patterns of light emitted by the separate arrays are combined upstream from or at the spatial light modulator.

EEE29. A display according to EEE28 wherein the separate arrays are arranged on a plurality of separate planes.

EEE30. A display according to EEE28 comprising an optical combiner arranged to combine light from the narrow-band light emitters of each type and deliver the combined light to illuminate the spatial light modulator.

EEE31. A display according to EEE28 wherein the light emitters of two or more of the types of the narrow-band light emitters are interspersed in one array and light issuing from the array is combined with light from one or more other types of the narrow-band emitters before passing to the spatial light modulator.

EEE32. A display according to EEE28 wherein light from the broadband light emitters is combined with light from one or more other types of the narrow-band emitters before passing to the spatial light modulator.

EEE33. A display according to EEE28 wherein the broadband light emitters and the light emitter of one or more of the types of the narrow-band light emitters are interspersed in one array and resulting light is combined with light from one or more other types of the narrow-band emitters and/or one or more other types of broadband light emitters before passing to the spatial light modulator.

EEE34. A display according to EEE11 wherein the light source comprises: a backlight comprising the broadband light emitting elements; and a light emitter array disposed in an optical path between the backlight and the spatial light modulator, the light emitter array comprising the groups of narrow-band light emitter elements.

EEE35. A display according to EEE34 wherein the broadband light-emitting elements comprise one or more LEDs.

EEE36. A display according to EEE34 wherein the light emitter array comprises areas of translucency or transparency which allow broadband light from the backlight to pass through the light emitter array onto the pixels of the spatial light modulator.

EEE37. A display according to EEE34 wherein the controller is configured to generate backlight control signals for controlling the light emitting elements of the backlight, color emitter control signals for controlling the light emitting elements of the light emitter array, and spatial light modulator control signals for controlling the pixels of the spatial light modulator.

EEE38. A display according to EEE11 wherein the controller is configured to control an optical transmissivity of the pixels.

EEE39. A display according to EEE11 wherein the pixels comprise optical shutters and the controller is configured to control an amount of time that each shutter remains open in any cycle.

EEE40. A display according to EEE11 wherein the pixels comprise a plurality of independently controllable sub-pixels associated with color filters corresponding to the primary colors wherein at least one sub-pixel is associated with each of the primary colors.

EEE41. A display according to EEE11 wherein the spatial light modulator comprises a reflection-type spatial light modulator.

EEE42. A display according to EEE11 wherein the spatial light modulator comprises a transmission-type spatial light modulator.

EEE43. A display according to EEE11 wherein the spatial light modulator comprises an LCD panel.

EEE44. A display according to EEE43 wherein the display panel comprises an RGB panel.

EEE45. A display according to EEE43 wherein the display panel comprises an RGBW panel.

EEE46. A display according to EEE41 wherein the spatial light modulator comprises a liquid crystal on silicon (LCOS) spatial light modulator.

EEE47. A display according to EEE11 wherein the controller is configured to alter a relative amount of the broadband light and the narrow-band light at a location on the spatial light modulator based at least in part on a corresponding chromaticity determined from the image data.

EEE48. A display according to EEE47 wherein the controller is configured to alter a relative amount of the broadband light and the narrow-band light at a location on the spatial light modulator based at least in part on a corresponding luminance determined from the image data.

EEE49. A display according to EEE48 wherein the controller is configured to alter a relative amount of the broadband light and the narrow-band light at a location on the spatial light modulator based at least in part on corresponding saturation values determined from the image data.

EEE50. A display according to EEE11 wherein the controller is configured to control a brightness of the light emitting elements.

EEE51. A display according to EEE11 wherein the controller comprises logic circuits provided by a configurable logic device.

EEE52. A display according to EEE51 wherein the configurable logic device comprises a field-programmable gate array (FPGA).

EEE53. A display according to EEE11 wherein the controller comprises one or more programmed data processors.

EEE54. A display according to EEE11 wherein the controller comprises a tangible storage medium that contains instructions that cause the controller to be configured to control the pixels and the light source.

EEE55. A display according to EEE11 wherein the controller is configured to determine a chromaticity for each area of the image to be displayed; control the broadband light emitting elements corresponding to the area to emit light if the chromaticity for the area is within a chroma region; and control the narrow-band light emitting elements corresponding to the area to emit light if the chromaticity for the area is not within a chroma region, wherein the chroma region is a subset of the colour gamut.

EEE56. A display comprising a viewing screen;

a color narrow-band projector arranged to project an image made up of narrow-band light of a plurality of colors onto the viewing screen;

a broadband light projector arranged to project an image made up of broadband light onto the viewing screen; and, a controller configured to control the relative amounts of broadband and narrow-band light projected to areas on the viewing screen.

EEE57. A display according to EEE56 wherein the narrow-band projector comprises a laser projector.

EEE58. A display according to EEE56 wherein the narrow-band projector comprises one or more spatial light modulators configured to imagewise modulate the projected narrow-band light.

EEE59. A display according to EEE56 wherein the narrow-band projector is configured to scan one or more beams of light onto the viewing screen.

EEE60. A display according to EEE56 wherein the broadband light comprises white light.

EEE61. A display according to EEE56 wherein the broadband light is introduced into an optical path of the narrow-band projector upstream from the viewing screen.

EEE62. A display according to EEE56 wherein a spatial resolution of the broadband projector is a factor of 2 to 20 smaller in each direction than a spatial resolution of the color narrow-band projector.

EEE63. A display according to EEE56 wherein the controller is configured to reduce the relative amount of broadband light at some locations on the viewing screen and to increase the relative amount of broadband light at other locations of the viewing screen.

EEE64. A method for displaying a color image, the method comprising, for each of a plurality of areas of the image:

determining a chromaticity for the area;

determining an amount of light in each of a plurality of spectral ranges required to replicate the area of the image;

if the chromaticity for the area is within a chroma region, controlling one or more broadband light emitters to generate at least the required amount of light for each of the spectral ranges for the area; and if the chromaticity for the area is outside the chroma region, controlling one or more narrow-band light emitters to generate at least a portion of the required amount of light for one or more of the spectral ranges for the area.

EEE65. A method for displaying a color image on a display, the display comprising a plurality of controllable narrow-band light emitting elements capable of emitting narrow-band light of a plurality of primary colors defining a color gamut and one or more broadband light emitting elements, the method comprising for each of a plurality of areas of the image to be displayed:

determining a representative chromaticity of the area;

determining if the representative chromaticity is in a defined chroma region;

if the representative chromaticity is not in the defined chroma region, then establishing driving signals for the narrow-band light emitting elements that correspond to the area;

if the representative chromaticity is in the defined chroma region, then establishing driving signals for the broadband light emitting elements that correspond to the area; and applying the driving signals to the broadband or narrow-band light emitting elements that correspond to the area.

EEE66. A method according to EEE65 comprising determining a representative luminance of the area of the image and defining the chroma region based at least in part on the representative luminance of the area.

EEE67. A method according to EEE65 wherein each area comprises a group of pixels.

EEE68. A method according to EEE67 wherein the representative chromaticity comprises an average chromaticity averaged over the pixels of the area.

EEE69. A method according to EEE67 wherein the representative chromaticity comprises a weighted average of chromaticity over the pixels of the area.

EEE70. A method according to EEE69 wherein pixels having more highly saturated chromaticities are weighted more heavily than other pixels in determining the weighted average.

EEE71. A method according to EEE69 wherein pixels located in contiguous groups with other pixels having similar chromaticities are weighted more heavily than other pixels in determining the weighted average.

EEE72. A method according to EEE66 wherein the representative luminance is determined separately for each of a plurality of color bands corresponding to the sub-pixels.

EEE73. A method according to EEE66 wherein the representative luminance comprises an average luminance averaged over the pixels of the area.

EEE74. A method according to EEE66 wherein the representative luminance comprises a maximum luminance of the pixels in the area.

EEE75. A method according to EEE66 wherein the representative luminance comprises a weighted average of luminance over the pixels of the area.

EEE76. A method according to EEE75 wherein brighter pixels are weighted more heavily in determining the representative luminance.

EEE77. A method according to EEE75 wherein pixels in contiguous groups with other pixels of similar brightness are weighted more heavily in determining the representative luminance.

EEE78. A method according to EEE65 wherein the chroma region comprises a region within the color gamut.

EEE79. A method according to EEE78 wherein the chroma region includes an achromatic point.

EEE80. A method according to EEE65 wherein the display comprises a spatial light modulator comprising an array of controllable pixels, each pixel comprising a plurality of sub-pixels, the method comprising estimating a light field at the spatial light modulator;

determining a driving signal for each sub-pixel based on a value of the estimated light field at a location of the sub-pixel; and, applying the driving signals to the sub-pixels.

EEE81. A method according to EEE80 wherein estimating the light field comprises determining and summing contributions of light from individually contributing light emitting elements based on the driving signal for each such light emitting element.

EEE82. A method according to EEE80 wherein determining the driving signal for each sub-pixel comprises dividing a desired luminance for the sub-pixel determined from the image data by a value of the estimated light field at the location of the sub-pixel.

EEE83. A method according to EEE65 comprising applying spatial and/or temporal filters to remove visible artefacts not part of the image data.

EEE84. A method according to EEE65 comprising blending light from broadband light emitters with light from narrow-band light emitters, wherein a ratio of broadband to narrow-band light is based at least in part on the representative chromaticity.

EEE85. A method according to EEE84 comprising blending light in response to determining the representative chromaticity is outside a first chroma region but inside a second chroma region.

EEE86. A method according to EEE85 wherein the first and second chroma regions are defined at least in part based on the representative luminance of the area.

EEE87. A method according to EEE84 comprising blending light based at least in part on the representative luminance.

EEE88. A method according to EEE87 comprising boosting a relative amount of broadband light for a particular image area in response to the representative luminance being above a threshold luminance.

EEE89. A method according to EEE84 comprising blending light based at least in part on a size of a MacAdam ellipse for the representative chromaticity.

EEE90. A method according to EEE89 comprising blending more broadband light for areas having a larger MacAdam ellipse than for areas having a smaller MacAdam ellipse.

EEE91. A method according to EEE89 comprising determining the ratio of broadband to narrow-band light based on a function that to a first order is proportional to the size of the MacAdam ellipse.

EEE92. A method according to EEE84 comprising determining the ratio of broadband to narrow-band light based at least in part on a distance from a reference point within the color gamut to the representative chromaticity.

EEE93. A method according to EEE92 comprising determining the ratio of broadband to narrow-band light based on a function of the distance from the reference point that drops off monotonically with distance from the reference point.

EEE94. A method according to EEE92 comprising determining the ratio of broadband to narrow-band light based on a function of the distance from the reference point that remains fixed up to a first distance from the reference point and then drops off monotonically with increasing distance from the reference point.

EEE95. A method according to EEE92 wherein the reference point comprises an achromatic point within the color gamut.

EEE96. A method according to EEE84 comprising blending light based at least in part on a saturation index for each primary color.

EEE97. A method according to EEE96 comprising increasing the ratio of broadband light to narrow-band light in response to the saturation indices for all of the primary colors being less than one or more threshold values.

EEE98. A method for displaying a color image, the method comprising generating portions of the image for which image data specifies colors having saturation values above a threshold with light from one or more narrow-band light emitters and generating portions of the image for which the image data specifies colors having saturation values below the threshold with light from one or more broadband light emitters.

EEE99. A method for displaying a color image using a plurality of controllable narrow-band light emitting elements capable of emitting narrow-band light of a plurality of primary colors and one or more controllable broadband light emitting elements, the method comprising, for each of a plurality of areas of the image:

1 determining a representative chromaticity and luminance for the area;

2 determining saturation indices for the primary colors based at least in part on the representative chromaticity and luminance;

3 comparing the saturation indices to first and second thresholds, wherein the second threshold is greater than the first threshold; and either 4 if all the saturation indices are less than the first threshold, determining driving values for the broadband light emitters corresponding to the area; or 5 if any of the saturation indices are greater than the second threshold, determining driving values for the narrow-band light emitters corresponding to the area; or 6 otherwise, if none of the saturation indices are greater than the second threshold and not all of the saturation indices are less than the first threshold, determining driving values for both the broadband and narrow-band light emitters corresponding to the area.

EEE100. A method according to EEE99 wherein the narrow-band and broadband light emitters are arranged to illuminate a spatial light modulator comprising an array of pixels.

EEE101. A method according to EEE100 wherein each pixel comprises a plurality of sub-pixels that pass light of spectral ranges corresponding to the primary colors, and wherein steps (d) to (f) comprise determining a required amount of light in each spectral range to replicate the image to be displayed.

EEE102. A method according to EEE101 wherein step (d) comprises applying known characteristics of a spectrum of the broadband light emitters to determine an amount of broadband light needed to provide at least the required amount of light in each spectral range.

EEE103. A method according to EEE101 wherein step (f) comprises first determining the driving values for the broadband light emitters and then determining the driving values for the narrow-band light emitters such that their combined light provides at least the required amount of light in each spectral range.

EEE104. A method according to EEE103 wherein step (f) comprises applying known characteristics of the spectrum of the broadband light emitters to determine an amount of broadband light needed to provide at least the required amount of light in each spectral range and then reducing the amount by a factor.

EEE105. A method according to EEE104 wherein the factor is based on one or more of the saturation indices.

EEE106. A method according to EEE105 wherein the factor is based on a highest one or more of the saturation indices.

EEE107. A method according to EEE105 wherein the factor is based on an average of the saturation indices.

EEE108. A method according to EEE103 wherein step (f) comprises applying known characteristics of a spectrum of the broadband light emitters to determine an amount of broadband light needed to provide at least the required amount of light in each spectral range but not taking into account light for the primary color having a highest saturation index.

EEE109. A method according to EEE103 wherein step (f) comprises applying known characteristics of a spectrum of the broadband light emitters to determine an amount of broadband light needed to provide at least the required amount of light in each spectral range but not taking into account light for a plurality of primary colors having highest saturation indices.

EEE110. A method according to EEE103 wherein step (f) comprises applying known characteristics of a spectrum of the broadband light emitters to determine an amount of broadband light needed to provide at least the required amount of light in each spectral range but taking into account only light for primary colors having lowest saturation indices.

EEE111. A method according to EEE110 wherein the determined amount of broadband light is reduced by a factor.

EEE112. A method according to EEE111 wherein factor is based on one or more of the saturation indices.

EEE113. A method according to EEE103 wherein step (f) comprises applying a predetermined amount of broadband light.

EEE114. A method according to EEE103 wherein step (f) comprises determining initial driving values for each type of narrow-band emitter without reference to the driving values of the broadband light and then, from the initial driving values for each type of narrow-band emitter, subtracting an amount of light contributed by the broadband light emitters in a corresponding wavelength range.

EEE115. A method according to EEE99 comprising applying spatial and/or temporal filters to remove visible artefacts not part of the image data.

EEE116. A method according to EEE99 wherein intensities of the broadband light emitters are controllable in fewer discrete steps than intensities of the narrow-band light emitters.

EEE117. A method according to EEE99 wherein the broadband light emitters are controllable to be either on or off.

EEE118. A method according to EEE100 wherein the broadband light emitters are controllable with a lower spatial resolution than the narrow-band light emitters.

EEE119. A method according to EEE118 wherein one broadband light emitter illuminates an entire face of the spatial light modulator and an amount of broadband light delivered to different areas of the spatial light modulator is not independently controllable.

EEE120. A method according to EEE118 wherein at least one broadband light emitter illuminates an entire face of the spatial light modulator at a level that is not controllable in response to image data.

EEE121. A method according to EEE120 wherein one or more other broadband light emitters are controllable in response to image data.

EEE122. A method for displaying a color image using a plurality of controllable narrow-band light emitting elements capable of emitting narrow-band light of a plurality of primary colors and one or more controllable broadband light emitting elements that are arranged to illuminate a two-dimensional spatial light modulator comprising an array of pixels, the method comprising for each of a plurality of areas of the spatial light modulator:

determining color values for pixels within the area;

determining an initial set of driving values for the narrow-band light emitting elements corresponding to the area based at least in part on the color values;

for pixels within the area, estimating an amount of desaturation resulting from illumination of the pixel from the narrow-band light emitting elements driven according to the initial set of driving values;

determining driving values for those of the broadband light emitting elements corresponding to the area based at least in part on the estimated amounts of desaturations; and recalculating the set of driving values for the narrow-band light emitting elements corresponding to the area based at least in part on the driving values of the broadband light emitting elements and information characterizing a spectrum of light from the broadband light emitting elements.

EEE123. A method according to EEE122 wherein the color values comprise values corresponding to each of the primary colors.

EEE124. A method according to EEE123 wherein the primary colors comprise red, green and blue.

EEE125. A method according to EEE123 wherein determining the initial set of narrow-band driving values is based on maximums of the color values for each primary color within the area.

EEE126. A method according to EEE123 wherein determining the initial set of narrow-band driving values is based on maximums of the color values for each primary color integrated over sub-areas within the area.

EEE127. A method according to EEE122 wherein estimating the amount of desaturation of a pixel is based on a brightness of illumination of the pixel by each of the narrow-band light emitters.

EEE128. A method according to EEE122 wherein estimating the amount of desaturation of a pixel is based on filter characteristics of the spatial light modulator.

EEE129. A method according to EEE122 wherein estimating the amount of desaturation of a pixel is based on transmission characteristics of the spatial light modulator.

EEE130. A method according to EEE122 comprising determining the driving values of the broadband light emitting elements based at least in part on threshold desaturation values for pixels within the area.

EEE131. A method according to EEE130 wherein the threshold desaturation values for each pixel are based on a function of indices of saturation of a colour specified for the pixel, such that if the color specified for a pixel or neighborhood of pixels is highly saturated for some primary color then the threshold desaturation corresponds to a small amount of desaturation, and if the color specified for the pixel or neighborhood of pixels is not very saturated for any primary color then the threshold desaturation corresponds to a greater amount of desaturation.

EEE132. A method according to EEE122 comprising determining the broadband driving values based on a comparison of the estimated desaturations to the threshold desaturations across all pixels in the area.

EEE133. A method according to EEE122 comprising determining the broadband driving values based on a comparison of the estimated desaturations to the threshold desaturations across selected pixels in the area.

EEE134. A method according to EEE122 comprising determining the broadband driving values based on a map indicating a comparison of the estimated desaturations to the threshold desaturations that is low-pass spatially filtered or averaged over sub-areas within the area.

EEE135. A method according to EEE122 wherein each pixel comprises a plurality of sub-pixels that pass light of color bands corresponding to the primary colors and which each have a transmissivity that is independently controllable within a range of adjustment of the sub-pixel.

EEE136. A method according to EEE135 wherein, when the narrow-band and broadband light sources are driven at their corresponding driving values, if an amount of light incident on a sub-pixel in a color band is greater than a desired amount as determined from image data, then the amount of light is modulated to the desired amount by reducing the transmissivity of the sub-pixel.

EEE137. A method for displaying a color image using a plurality of controllable narrow-band light emitting elements capable of emitting narrow-band light of a plurality of primary colors and one or more controllable broadband light emitting elements that are arranged to illuminate a two-dimensional spatial light modulator comprising an array of pixels, the method comprising:

determining an initial set of driving values for the broadband light emitting elements based at least in part on a desired luminance at each pixel;

identifying pixels at which illumination of broadband light according to the initial set of broadband driving values is insufficient to allow either the desired luminance or a desired saturation at the pixel;

for the pixels identified, if any, determining driving values for corresponding narrow-band light emitting elements sufficient to allow the desired luminance and the desired saturation at the pixel; and adjusting the driving values for the broadband light emitting elements based at least in part on the driving values of the narrow-band light emitting elements.

EEE138. A method according to EEE137 wherein each pixel comprises a plurality of subpixels each associated with a spectral range and the method comprises, for each spectral range, producing a map identifying pixels at which illumination of broadband light according to the initial set of broadband driving values is insufficient to provide either the desired luminance or the desired saturation at the pixel.

EEE139. A method according to EEE138 wherein producing the maps comprises: performing a light field simulation (LFS) based on the illumination of broadband light; and, based on the LFS, determining subpixel control values needed to produce the desired image.

EEE140. A method according to EEE139 wherein identifying pixels having insufficient lumination comprises identifying subpixel control values greater that a maximum allowed value for the subpixel.

EEE141. A method according to EEE139 wherein identifying pixels having insufficient saturation comprises identifying subpixel control values less than zero.

EEE142. A method according to EEE139 comprising, after adjusting the driving values for the broadband light emitting elements based at least in part on the driving values of the narrow-band light emitting elements, adjusting the LFS and subpixel control values based at least in part on the driving values of the broadband and narrow-band light emitting elements.

EEE143. A controller for a colour display, the display comprising a plurality of controllable narrow-band light emitting elements, one or more controllable broadband light emitting elements and a spatial light modulator comprising an array of controllable pixels, wherein the controller is configured to display a color image by: determining a representative chromaticity for an area of the image; determining a relative amount of broadband light to narrow-band light to provide to a corresponding area of the spatial light modulator based at least in part on the representative chromaticity; controlling the broadband and narrow-band emitting elements to provide the determined relative amounts of broadband to narrow-band light to the area; and controlling the pixels of the spatial light modulator to adjust an amount of the light that is passed to a viewer to replicate the image to be displayed.

EEE144. A tangible storage medium containing computer instructions that can cause a data processor in a controller for a colour display to perform a method of displaying a color image, the display comprising a plurality of controllable narrow-band light emitting elements, one or more controllable broadband light emitting elements and a spatial light modulator comprising an array of controllable pixels, the method comprising: determining a representative chromaticity for an area of the image; determining a relative amount of broadband light to narrow-band light to provide to a corresponding area of the spatial light modulator based at least in part on the representative chromaticity; controlling the broadband and narrow-band emitting elements to provide the determined relative amounts of broadband to narrow-band light to the area; and controlling the pixels of the spatial light modulator to adjust an amount of the light that is passed to a viewer to replicate the image to be displayed.

EEE145. A method for displaying a color image, the method comprising, for each of a plurality of areas of the image:

determining a saturation value corresponding to the area for each of a plurality of spectral ranges;

comparing the saturation values to corresponding thresholds;

if the saturation values are less than the corresponding thresholds, generating the area of the image with light from one or more broadband light emitters; and, if one or more of the saturation values exceeds the corresponding threshold generating the area of the image with light from one or more narrow-band light emitters.

As will be apparent to those skilled in the art in the light of the foregoing disclosure, many alterations and modifications are possible in the practice of this invention without departing from the spirit or scope thereof. For example, features of the various embodiments described herein may be combined with features of other embodiments to yield additional embodiments. Designs of existing or future displays may be modified to incorporate features as described herein. Accordingly, the scope of the invention is to be construed in accordance with the substance defined by the following claims.

What is claimed is:

1. A display comprising:

a spatial light modulator comprising an array of controllable pixels, each pixel comprising a plurality of subpixels;

a plurality of primary color light-emitting elements arranged to illuminate the spatial light modulator with light of a plurality of colors;

at least one broadband light-emitting element having a spectral bandwidth at half maximum of at least 150 nm and being arranged to illuminate the spatial light modulator; and a controller that is configured for:

estimating a light field at the spatial light modulator, wherein the light field is generated by one or more of the light-emitting elements, determining a driving signal for each sub-pixel based on a value of the estimated light field at a location of the sub-pixel, and applying the driving signals to the sub-pixels;

wherein:

the broadband light-emitting element is controllable to alter an amount of the light at a location on the spatial light modulator and the controller is connected to receive image data and configured to determine from the image data a chromaticity corresponding to the location on the spatial light modulator and, based at least in part on the chromaticity, control the amount of the broadband light at the location on the spatial light modulator;

the controller is configured to determine, from the chromaticity determined from the image data corresponding to a location on the spatial light modulator, a saturation index for each of a plurality of primary colors, wherein the saturation index for each primary color is a measure of how closely light of the primary color alone matches the chromaticity, and, based on the saturation indices, control the amount of the broadband light at the location on the viewing screen; and the controller is configured to determine whether the chromaticity falls within a region of chromaticity values, wherein the region corresponds to, or is a region within, a gamut that can be accurately reproduced if the spatial light modulator is illuminated only by light from the at least one broadband light-emitting element, and, if so, suppress illumination of the location with the primary color light.

2. A display according to claim 1 wherein the primary color light-emitting elements comprise organic LEDs controllable to alter an amount of the primary color light at the location on the spatial light modulator.

3. A method for displaying a color image on a display, the display comprising a plurality of controllable primary color light-emitting elements capable of emitting light of a plurality of primary colors defining a color gamut, and one or more broadband light-emitting elements having a spectral bandwidth at half maximum of at least 150 nm, the method comprising, for each of a plurality of areas of the image to be displayed:

determining a representative chromaticity of the area;

determining if the representative chromaticity is in a defined region of chromaticity values, wherein the region corresponds to, or is a region within, a gamut that can be accurately reproduced if the spatial light modulator is illuminated only by light from the one or more broadband light-emitting elements;

if the representative chromaticity is not in the defined region of chromaticity values, then establishing driving signals for the primary color light-emitting elements that correspond to the area;

if the representative chromaticity is in the defined region of chromaticity values, then establishing driving signals for the broadband light-emitting elements that correspond to the area;

applying the driving signals to the broadband or primary color light emitting elements that correspond to the area;

determining driving values for pixels of a spatial light modulator illuminated by the broadband or primary color light emitting elements based on the color image and an estimate light field at the spatial light modulator; and applying the driving values to the spatial light modulator.

4. A method according to claim 3 comprising determining a representative luminance of the area of the image and defining the region of chromaticity values based at least in part on the representative luminance of the area.

5. A method according to claim 3, wherein the display comprises a spatial light modulator comprising an array of controllable pixels, each pixel comprising a plurality of sub-pixels, the method comprising:

estimating the light field at the spatial light modulator, wherein the light field is generated by one or more of the light-emitting elements;

determining a driving signal for each sub-pixel based on a value of the estimated light field at a location of the sub-pixel; and, applying the driving signals to the sub-pixels.

6. The method of claim 5 comprising estimating separate light fields for spectral ranges corresponding to each color of the sub-pixels.

7. The method of claim 5 comprising estimating the light field at the spatial light modulator by determining and summing light from individual contributing light-emitting elements for a plurality of locations on the spatial light modulator.

8. A method according to claim 7 wherein estimating the light field comprises determining and summing contributions of light from the individually contributing light-emitting elements based on the driving signal for each such light-emitting element.

9. A method according to claim 3 comprising blending light from broadband light-emitting elements with light from primary color light-emitting elements, wherein a ratio of an amount of light from the broadband light-emitting elements to an amount of light from the primary color light-emitting elements is based at least on the representative chromaticity.

10. A method according to claim 9 comprising blending light based at least in part on a size of a MacAdam ellipse for the representative chromaticity, wherein for chromaticities for which the MacAdam ellipse is larger more broadband light is provided than for chromaticities for which the MacAdam ellipse is smaller.

* * * * *